US005520379A

United States Patent [19]

Tanjo et al.

[11] Patent Number: 5,520,379

[45] Date of Patent: May 28, 1996

[54] DOCUMENT CONVEYING APPARTUS

[75] Inventors: Toru Tanjo; Yasushi Kamezaki; Takashi Kotani; Yukio Tanisaki; Masahiro Nakagawa; Hiroyuki Harada; Masahiro Sako; Hiromichi Oguma, all of Osaka, Japan

[73] Assignee: Mita Industrial Co., Ltd., Osaka, Japan

[21] Appl. No.: 216,976

[22] Filed: Mar. 24, 1994

[30] Foreign Application Priority Data

Mar. 24, 1993 [JP] Japan ..... 5-089316

[51] Int. Cl.[6] ..... B65H 5/06

[52] U.S. Cl. ..... 271/4.1; 271/3.08; 355/322

[58] Field of Search ..... 271/3.02, 3.05, 271/3.01, 3.14, 184, 177, 220, 308, 269, 84, 85, 223, 227, 229, 230, 233, 236, 241; 355/311, 321, 322

[56] References Cited

U.S. PATENT DOCUMENTS 3,095,192 6/1963 Simjian ..... 271/220

3,980,297 9/1976 Bulso, Jr. et al. ..... 271/269

4,003,570 1/1977 Yamanaka ..... 271/269 X 5,143,363 9/1992 Irie et al. ..... 271/223 X

*Primary Examiner*—William E. Terrell

*Assistant Examiner*—Tamara Kelly

*Attorney, Agent, or Firm*—Antonelli, Terry, Stout & Kraus

[57] ABSTRACT

A document conveying apparatus has a document pushing-down/adjusting mechanism disposed at an upper position on the downstream side of a document discharge port. The document pushing-down/adjusting mechanism acts on the rear end of the document on delivery after its rear end is substantially liberated from being nipped by a pair of document discharge rollers, forcibly pushes the rear end of the document down toward the upstream end position on the document-placing plate means, and holds the document for the document-placing plate means for a predetermined period of time.

18 Claims, 25 Drawing Sheets

DOCUMENT CONVEYING APPARTUS

FIELD OF THE INVENTION

The present invention relates to a document conveying apparatus of a type in which a document placed on a document-placing plate means is introduced onto a document conveying passage that extends along a transparent plate in a document processor, passing through a document introduction passage, and is delivered onto a document-placing plate means from the document conveying passage, passing through a document delivery passage. Particularly, the invention relates to a document conveying apparatus of a type in which a document delivered onto a document-placing plate means is introduced again into the document conveying passage, passing through the document introduction passage.

DESCRIPTION OF THE PRIOR ART

A document conveying apparatus of the so-called circulation type has heretofore been adapted to a document processor such as an electrostatic copying machine, an image reader or the like, and has been placed in practical use. Such a document conveying apparatus comprises a document-placing plate means positioned above a transparent plate of a document processor; a document introduction passage disposed between the document-placing plate means and a document conveying passage that extends along the surface of the transparent plate; a document delivery passage disposed between the document conveying passage and the document-placing plate means; a document introduction means which successively introduces a plurality of pieces of documents placed in a stacked form on the document-placing plate means into the document conveying passage through the document introduction passage, starting with the document at the lowermost position; a document conveying means for conveying the documents through the document conveying passage; and a document delivery means which delivers the document conveyed from the document conveying passage onto the document-placing plate means through the document delivery passage.

The plurality of documents that are to be copied or read out are placed, being stacked, at a predetermined position on the document-placing plate means. Among the documents stacked, the document at the lowermost position is first introduced into the document conveying passage through the document introduction passage and is placed at a predetermined position in the document conveying passage. After predetermined processing is executed, such as exposure of image to light or image reading, the document is delivered from the document conveying passage onto the document-placing plate through the document delivery passage. The document delivered from the document delivery passage is delivered onto the uppermost document on the document-placing plate. As the documents of the lower positions are successively conveyed, the document placed on the uppermost one then goes downwards and finally arrives at the lowermost position in the stack, and when plural copies are to be made, is again introduced into the document conveying passage through the document introduction passage.

In the document conveying apparatus of the above-mentioned type, it is important that the document delivered onto the document-placing plate means be very reliably brought to a required position on the document-placing plate means, so that the document delivered onto the document-placing plate means is introduced again through the document introduction passage. It is further important that the document delivered from the document delivery passage onto the document-placing plate means be placed at the uppermost position of documents without being mixed into the documents that are existing already, being stacked, on the document-placing plate means. If a document delivered from the document delivery passage is mixed into the stack of documents on the document-placing plate means, the order of the documents in the stack changes.

When documents of a predetermined length only are treated, without differences in their length in the conveying direction, the above-mentioned requirement can be satisfied relatively easily by suitably setting the position of the document discharge port, provided at the downstream end of the document delivery passage, both in the up-and-down direction and in the conveying direction with respect to the surface of the document-placing plate means. In practice, however, there exist documents of a variety of sizes, and in most cases it is desired to handle documents of various sizes. In such a case, it is not necessarily easy to satisfy the aforementioned requirement.

According to the document conveying apparatuses disclosed in Japanese Laid-Open Patent Publications Nos. 143,125/1988, 202,556/1988 and 91,768/1991, the downstream end of the document delivery passage is disposed in a manner permitting it to be extended or contracted in the direction in which the surface of the document-placing plate means extends, i.e., the document discharge port at the downstream end of the document delivery passage is disposed in a manner permitting it to be moved in the direction in which the surface of the document-placing plate means extends, and the document discharge port is moved along the surface of the document-placing plate means, either automatically or by hand, to meet the length of the document in the direction in which it is conveyed, in order to satisfy the aforementioned requirements.

According to a document conveying apparatus disclosed in Japanese Laid-Open Utility Model Publication No. 193,336/1985, the downstream portion of the document delivery passage is upwardly extended beyond the upstream portion of the document-placing plate means, a plurality of document discharge ports are formed, spaced well apart in the direction of conveyance in the downstream portion of the document conveying passage, and document transfer control means are disposed, being related to each of the document discharge ports excluding the document discharge port of the most downstream side. The documents that are delivered onto the document-placing plate means through the document delivery passage are discharged through a document discharge port that is selected in accordance the length of the document in the direction of conveyance thereof.

In the document conveying apparatuses of the above-mentioned type, the document-placing plate means is provided with a pair of width restriction members that are movable in the direction of width, and under the document-placing plate means there is provided a moving mechanism that moves the pair of width restriction members in the directions to approach, or separate away from, each other. It is important that these width restriction members be stably moved in parallel with each other even when they are long. According to the document conveying apparatus disclosed in Japanese Laid-Open Patent Publication No. 202,556/1988, the mechanism for moving the pair of width restriction members is constructed to be moved by a rack-and-pinion mechanism.

However, in the document conveying apparatus of a type in which the document discharge port is movably disposed, the user must move by hand the document discharge port to meet a change in the length of the document in the direction of conveyance thereof, which requires cumbersome operation to move the document discharge port by hand. When the document discharge port is to be automatically moved, the document conveying apparatus must be equipped with a mechanism which is considerably complex, large in size, heavy in weight, and expensive. As a result, a heavy load is exerted on the hinge for opening and closing the document conveying apparatus, and this often causes hindering of the opening/closing operation. When the document discharge port is to be automatically moved, in particular, the moving mechanism exposed outside the document conveying apparatus must be equipped with a safety measure.

In the document conveying apparatus of a type in which a plurality of document discharge ports are disposed in the downstream portion of the document delivery passage that upwardly extends beyond the upstream portion of the document-placing plate means, on the other hand, when a document which is relatively long in the direction of conveyance is placed on the document-placing plate means, the constituent elements related to the downstream portion of the document delivery passage must be moved from the document-placing plate means such that the downstream portion of the document-placing plate means is exposed. When the document is particularly long in the direction of conveyance thereof, therefore, the user must perform a cumbersome operation.

In the document conveying apparatus of a type in which a mechanism for moving the pair of width restriction members is constructed to be moved by a rack-and-pinion mechanism, it is difficult to stably move the width restriction members in parallel with each other when these width restriction members are long.

SUMMARY OF THE INVENTION

A principal object of the present invention is to provide a novel and improved document conveying apparatus which is capable of reliably setting the positions for delivering documents of various sizes and which has a relatively compact and inexpensive constitution, liberating the operator from carrying out cumbersome operation.

Another object of the present invention is to provide a novel and improved document conveying apparatus which is capable of moving the pair of width restriction members stably and in parallel with each other, even when these width restriction members are long.

The above-mentioned technical problems commonly exist not only in a the document conveying apparatus of the circulation type in which a document delivered onto the document-placing plate means is introduced again into the document conveying passage through the document introduction passage, but also in document conveying apparatus of the type in which a document is simply delivered from the document delivery passage onto the document-placing plate means (i.e., of the type in which the document-placing plate means is simply used as a plate for receiving the documents that are delivered).

According to one aspect of the present invention, provision is made of a document pushing-down/adjusting mechanism which is disposed at an upper position on the downstream side of the document discharge port, acts on the rear end of a document on delivery of which the rear end is substantially liberated from being nipped by a pair of document discharge rollers, forcibly pushes down the rear end of the document toward the upstream end of the document-placing plate means, and holds the document for the document-placing plate means for a predetermined period of time.

According to another aspect of the present invention, provision is made of a document drawing/adjusting mechanism which pushes from the upper direction the rear end of the document that has been delivered onto the document-placing plate means through the document delivery passage to draw it toward the upstream direction and holds the document for a predetermined period of time.

According to a further aspect of the present invention, a mechanism for moving the pair of width restriction members is so constituted as to include a first rack-and-pinion mechanism and a second rack-and-pinion mechanism that are disposed spaced apart in the document conveying direction and extend in the direction of width, as well as to include an interlocking means that interlocks the first rack-and-pinion mechanism and the second rack-and-pinion mechanism in a synchronized manner. The pair of width restriction members are coupled to the first rack-and-pinion mechanism and to the second rack-and-pinion mechanism.

The document conveying apparatus constituted according to the present invention is provided with a document pushing-down/adjusting mechanism at an upper position on the downstream side of the document discharge port. After being substantially liberated from being nipped by the pair of document discharge rollers, the rear end of the document delivered from the document discharge port of the document delivery passage is then forcibly pushed down to the upstream end position of the document-placing plate means. The rear end of the document is then held for the document-placing plate means for a predetermined period of time. As a result, the rear end of the document delivered onto the document-placing plate means from the document discharge port is adjusted to its delivered position.

The document drawing/adjusting mechanism pushes from the upper direction the rear end of the document that has been delivered onto the document-placing means through the document delivery passage. This mechanism then draws the document toward the upstream direction and holds its position for a predetermined period of time. As a result, the rear end of the document delivered onto the document-placing plate means from the document discharge port is adjusted to and held at the upstream end of the document-placing plate means.

The pair of width restriction members are moved in a synchronized manner by the first rack-and-pinion mechanism and the second rack-and-pinion mechanism that are arranged spaced apart in the document-conveying direction and extend in the direction of width. Therefore, even the pair of long width restriction members are allowed to stably move in parallel with each other.

DETAILED DESCRIPTION OF THE PREFERRED EMBODIMENTS

Figure 1:
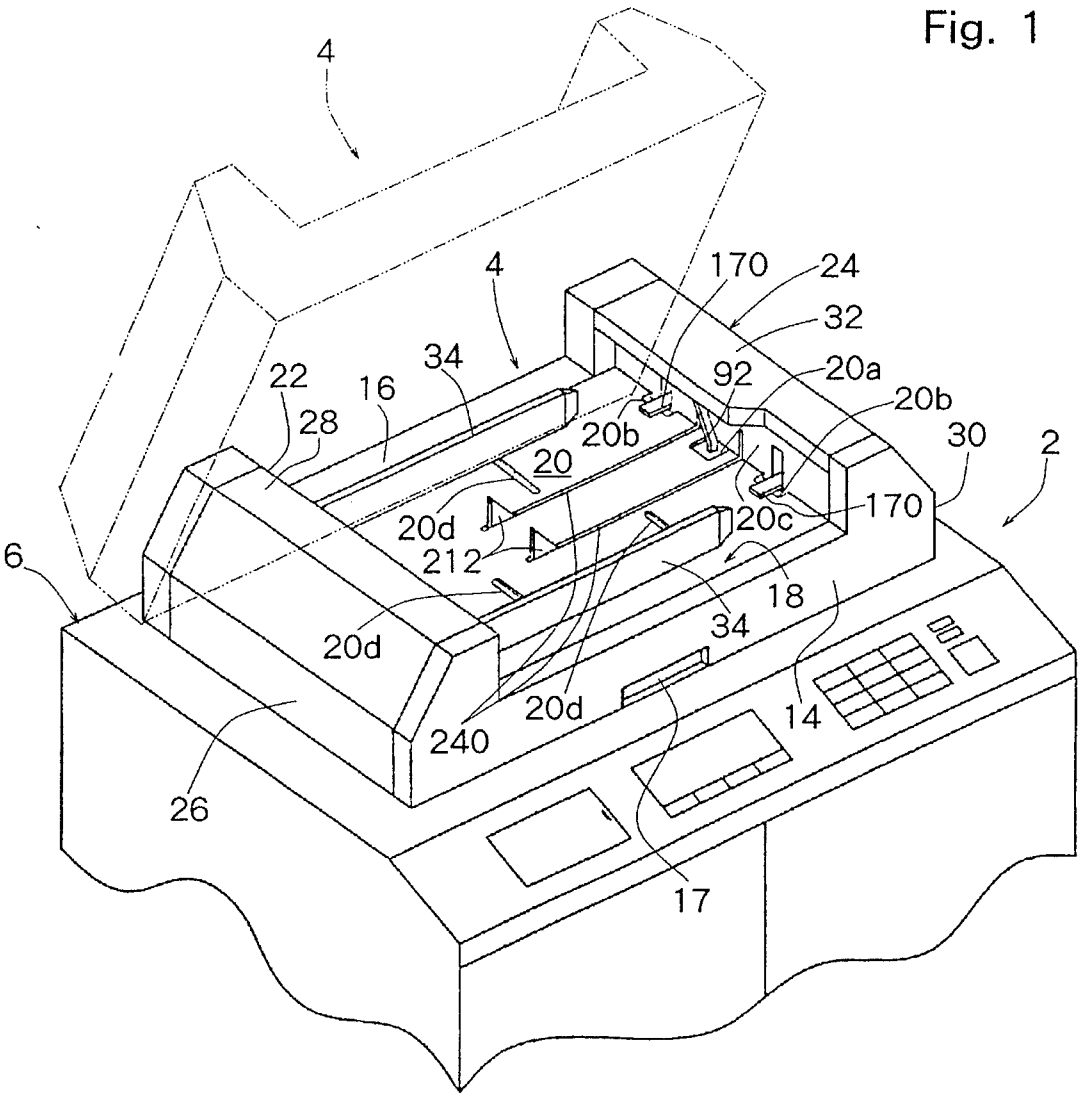
FIG. 1 is a perspective view illustrating an electrostatic copying machine equipped with a document conveying apparatus that is constituted according to a preferred embodiment of the present invention.
Figure 2:
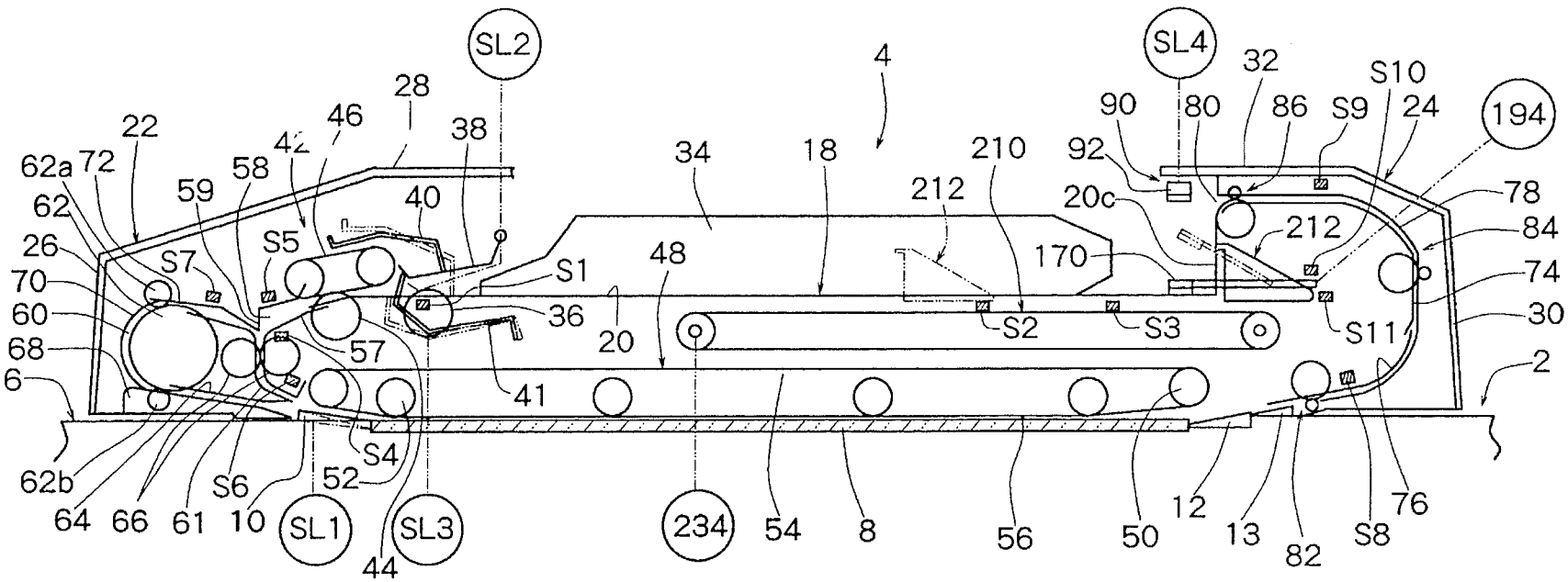
FIG. 2 is a sectional view of the document conveying apparatus shown in FIG. 1.

A preferred embodiment of the document conveying apparatus of the circulation type constituted according to the present invention will now be described in detail in conjunction with the accompanying drawings. Outline of the Whole Constitution:

FIGS. 1 and 2 illustrate an upper end portion of an electrostatic copying machine 2 and a document conveying apparatus 4 which is mounted thereon. The electrostatic copying machine 2 has a housing 6, and a transparent plate 8 (FIG. 2), which may be a glass plate, is disposed on the upper surface of the housing 6. On one side of the transparent plate 8 (left side in FIG. 2) is disposed a document restriction member 10, and on the other side thereof (right side in FIG. 2) are disposed stationary mounting members 12 and 13. The document restriction member 10 is mounted to freely pivot between an ascended position indicated by a solid line in FIG. 2 and a descended position indicated by a two-dot chain line in FIG. 2. When the document restriction member 10 is located at the ascended position, the end thereof (right edge in FIG. 2) is upwardly protruded slightly beyond the upper surface of the transparent plate 8. When the document restriction member 10 is lowered to the descended position, the end thereof is descended to be lower than the upper surface of the transparent plate 8. The document restriction member 10 is provided with an electromagnetic solenoid SL1, and is brought to the ascended position when the electromagnetic solenoid SL1 is de-energized and is brought to the descended position when the electromagnetic solenoid SL1 is energized. The document conveying apparatus 4 constituted according to the present invention is mounted on the upper surface of the housing 6 of the electrostatic copying machine 2 to freely pivot between a closed position indicated by a solid line in FIG. 1 and an open position indicated by a two-dot chain line about the axis of rotation which extends along the rear edge of the transparent plate 8. When a document is to be placed by hand on the transparent plate 8 of the electrostatic copying machine 2, the document conveying apparatus 4 is brought to the open position so that the transparent plate 8 is exposed. The document is then placed at a predetermined position on the transparent plate 8, and the document conveying apparatus 4 is brought to the closed position to cover the transparent plate 8 and the document that is placed thereon. In placing the document on the transparent plate 8, an edge of the document is brought into contact with the front edge of the document restriction member 10 that is located at the acting or ascended position, so that the document is placed at the predetermined position. When the document is to be automatically introduced onto the transparent plate 8 and is then delivered from the transparent plate 8, the document conveying apparatus 4 is brought to the closed position.

With reference to FIG. 1, the illustrated document conveying apparatus 4 includes a front-side cover 14 and a rear-side cover 16 that are disposed maintaining a distance in the back-and-forth direction (which is perpendicular to the surface of the paper in FIG. 2). In the front surface of the front-side cover 14 is formed a recessed portion 17 in which fingers can be inserted to open or close the document conveying apparatus 4. The front-side cover 14 and the rear-side cover 16 can be made of a suitable synthetic resin. Inside the rear-side cover 16 is disposed a rear support board (not shown) which is pivotably mounted on the upper surface of the housing 6 of the electrostatic copying machine 2 via a mounting mechanism (not shown) which may be of a known structure. A variety of constituent elements of the document conveying apparatus 4 are directly or indirectly supported by the rear support board. A document-placing plate means 18 is disposed between the front-side cover 14 and the rear-side cover 16. The document-placing plate means 18 is defined by a stationary plate 20 of a synthetic resin that extends substantially horizontally. A left end cover 22 is disposed between the left end of the front-side cover 14 and the left end of the rear-side cover 16, and a right end cover 24 is disposed between their right ends. The left end cover 22 has an upper wall portion 28 which extends over the downstream portion of the document-placing plate means 18 together with a left end wall portion 26 which covers the left end surface of the document conveying apparatus 4. The right end cover 24 has a right end wall portion 30 which covers the right end surface of the document conveying apparatus 4 and an upper wall portion 32 which extends toward the left from the upper end of the right end wall portion 30.

Figure 23:
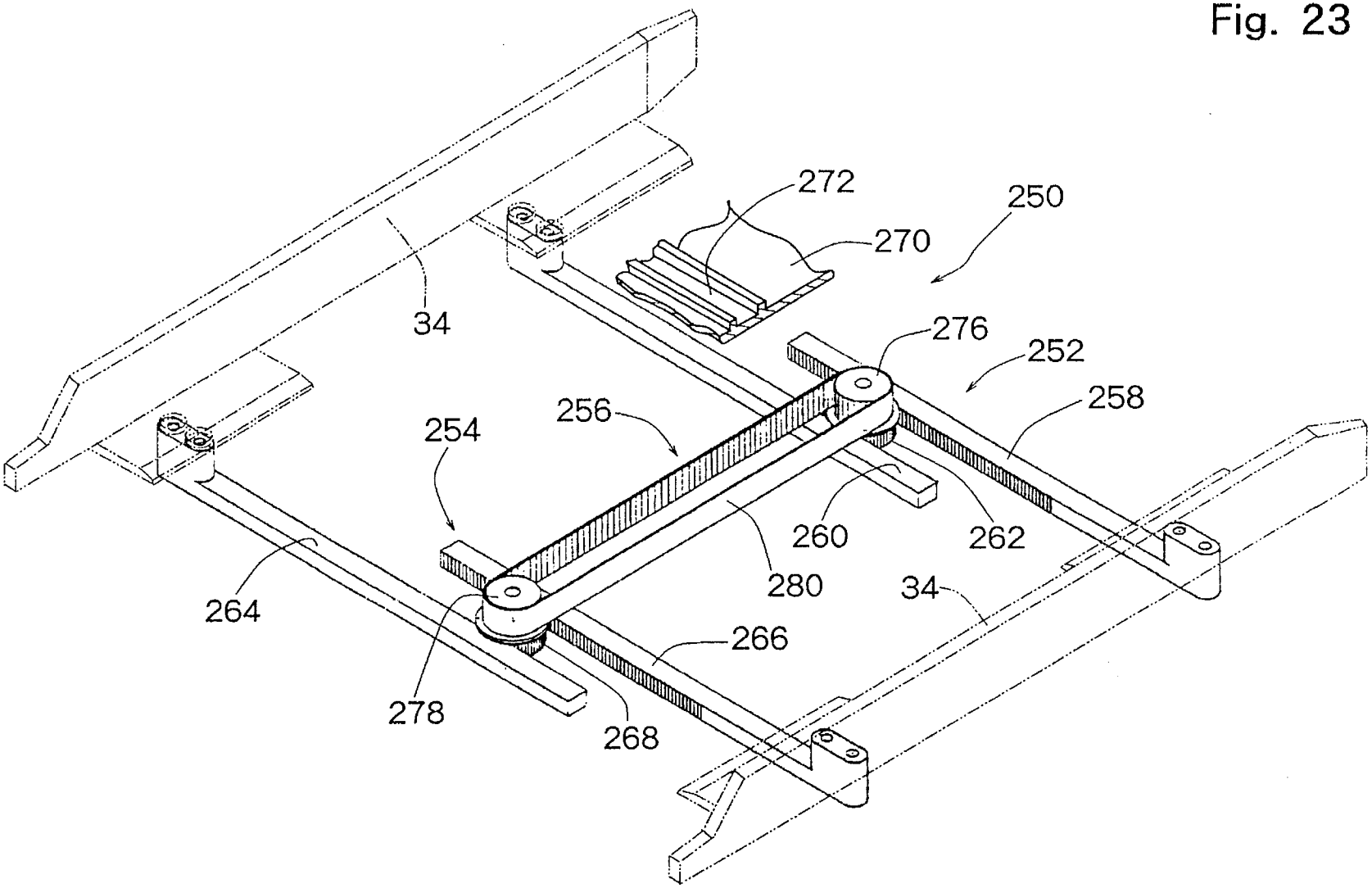
FIG. 23 is a perspective view which schematically illustrates a mechanism for moving the width restriction members.

With reference to FIGS. 1 and 2, the stationary plate 20 of the document-placing plate means 18 is provided with a pair of width restriction members 34 that are movable in the direction of width. Such a pair of width restriction members 34 are coupled to each other via a width restriction member-moving mechanism 256, that will be described later in conjunction with FIG. 23, provided under the stationary plate 20, and are movable by hand, being linked to each other, in a direction to approach or separate away from, each other. A pair of openings (not shown) which are in alignment in the direction of width are formed in the stationary plate 20 on the downstream side of the pair of width restriction members 34, and a pair of feed rollers 36 which are pivotably disposed are permitted to upwardly protrude through the openings. As shown in FIG. 2, a pushing member 38 is mounted in relation to the feed rollers 36 above the stationary plate 20. The pushing member 38 is provided with an electromagnetic solenoid SL2. When the electromagnetic solenoid SL2 is de-energized, the pushing member 38 is located at an ascended position which is indicated by solid lines in FIGS. 2 and 4. When the electromagnetic solenoid SL2 is energized, however, the pushing member 38 is resiliently urged in the counterclockwise direction in FIG. 2, thereby to push the document placed on the stationary plate 20 onto the feed rollers 36 (see two dot chain lines in FIGS. 2 and 4).

Figure 3:
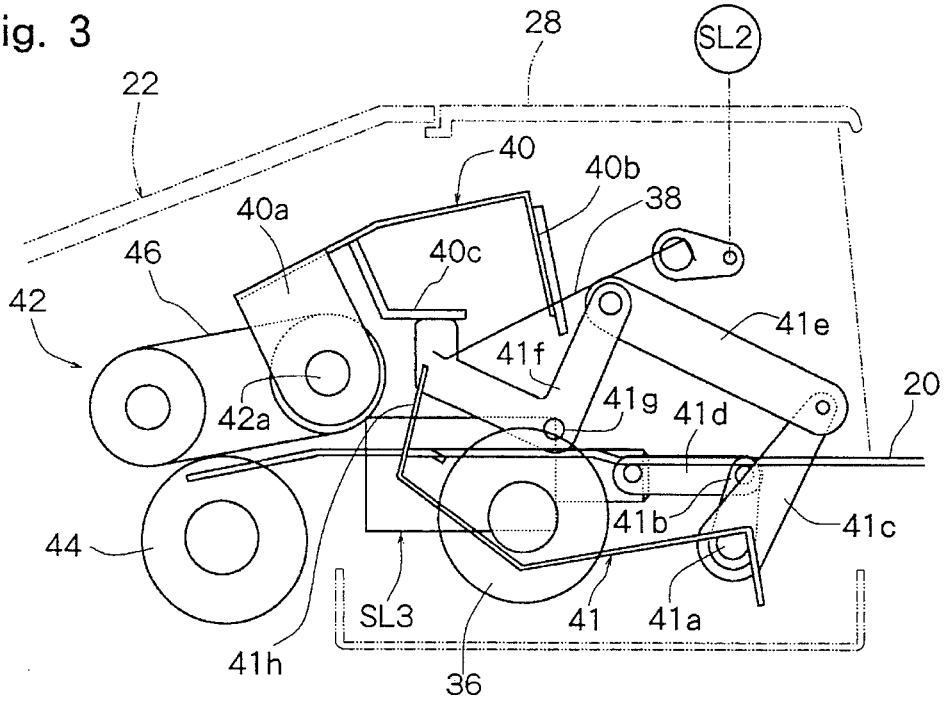
FIG. 3 is a side view which schematically illustrates a front-end-of-document restriction member and a constitution related thereto.
Figure 4:
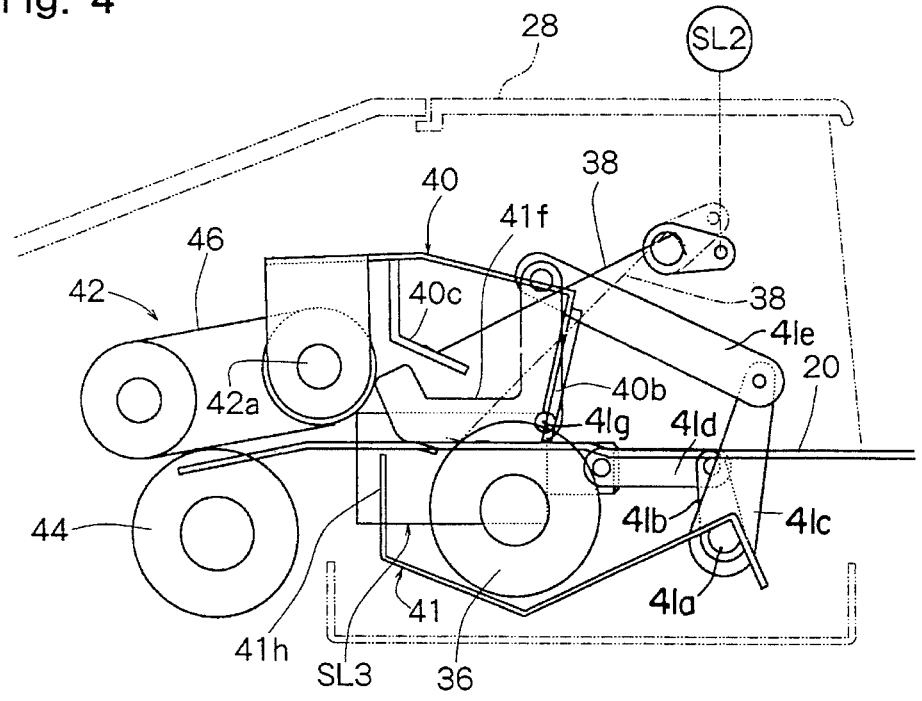
FIG. 4 is a side view which schematically illustrates another operation condition of the member of FIG. 3.

A front-end-of-delivered-document restriction member 40 is disposed at a downstream end position of the stationary plate 20, i.e., at an upper position covered by the upper wall portion 28 of the left end cover 22, and a front-end-of-document restriction member 41 is disposed at a lower position at the downstream end position of the stationary plate 20. With reference to FIGS. 3 and 4, a shaft **41*a* is pivotably disposed at an position upstream of the feed roller 36, spaced apart therefrom and in parallel therewith. To the shaft 41*a* is secured an end of the front-end-of-document restriction member 41 so as to rotate together therewith. To the shaft 41*a* are secured the ends of two levers 41*b* and 41*c*. The other end of the lever 41*b* is coupled to the electromagnetic solenoid SL3 via a lever 41*d*. The other end of the lever 41*c* is coupled to an end of a stop lever 41*f* via a lever 41*e*. The stop lever 41*f* has an L-shape and is pivotably supported at its corner portion via a shaft 41*g*. These levers are located at the back of the document conveying apparatus 4 (rear side as viewed from the operator and in the left upper direction in FIG. 1). The other end on the left side of the front-end-of-document restriction member 41 is defined by a pair of restriction portions 41*h* that upwardly extend, maintaining a distance in the back-and-forth direction (in the front-and-back direction in FIG. 3), and in the corresponding portions of the stationary plate 20 are formed notches (not shown) that permit the movement between the ascended position where the restriction portions 41*h* protrude beyond the upper surface of the stationary plate 20 and the descended position where they withdraw under the stationary plate 20**.

The front-end-of-delivered-document restriction member 40 is pivotably supported by a shaft **42*a* via a support bracket 40*a* that is provided at an end. A shaft included in a document separation means 42 is commonly used for the shaft 42*a*. The other end on the right side of the front-end-of-delivered-document restriction member 40 is defined by three restriction members 40*b* that downwardly extend, maintaining a distance in the back-and-forth direction. An L-shaped stopper 40*c* is provided under the intermediate portion of the front-end-of-delivered-document restriction member 40. The thus constituted front-end-of-delivered-document restriction member 40 is able to turn about its shaft 42*a* in the clockwise direction in FIG. 3 due to its own weight. As shown in FIG. 3, however, the stopper 40*c* comes in contact with the other end of the stop lever 41*f*** to restrict its turning.

When the electromagnetic solenoid SL3 is de-energized (see FIG. 3), the front-end-of-document restriction member 41 is urged in the clockwise direction in FIG. 3 due to a spring (not shown) that is provided for the electromagnetic solenoid SL3 and, as a result, the restriction portions **41*h* are brought to the ascended positions beyond the upper surface of the stationary plate 20 (refer also to a position indicated by a solid line in FIG. 2). The restriction portions 41*h* of the front-end-of-document restriction member 41 restrict the front end of the document placed on the stationary plate 20 from moving in the downstream direction. On the other hand, the other end of the stop lever 41*f* is located at an uppermost position, whereby the front-end-of-delivered-document restriction member 40 is restricted by the stop lever 41*f* from turning, and the restriction portions 40*b* are brought to the ascended positions spaced apart above the stationary plate 20 (refer also to a position indicated by a solid line in FIG. 2). When the electromagnetic solenoid SL3 is energized (see FIG. 4), the front-end-of-document restriction member 41 is turned in the counterclockwise direction via the levers 41*d*, 41*b* and shaft 41*a*. As a result, the restriction portions 41*h* are brought to the descended positions under the lower surface of the stationary plate 20 (refer also to a position indicated by a two-dot chain line in FIG. 2). The stop lever 41*f*, on the other hand, is turned about the shaft 41*g* in the counterclockwise direction via the levers 41*c* and 41*e*. As a result, the other end of the stop lever 41*f* moves downwards to separate away from the stopper 40*c* of the front-end-of-delivered-document restriction member 40. Therefore, the front-end-of-delivered-document restriction member 40 turns in the clockwise direction due to its own weight, and the lower ends of the restriction portions 40*b* are brought to the descended positions that come in contact with the upper surface of the stationary plate 20 (refer also to the position indicated by a two dot-chain line in FIG. 2). In the case of this operation, the document has been placed on the upper surface of the stationary plate 20 with which will come into contact the lower end of the restriction portions 40***b*. Therefore, the lower ends of the restriction portions 40*b* are held under the condition of being brought into contact with the uppermost surface of the document.

A document separation means 42 is disposed on the downstream side of the feed roller 36. The document separation means 42 is constituted by a separation roller 44 which upwardly protrudes through a notch formed in the stationary plate 20 and a separation belt mechanism 46 which is disposed above the separation roller 44, being opposed thereto. The separation roller 44 is rotated in the counterclockwise direction in FIG. 2, and the separation belt mechanism 46 is rotated in the counterclockwise direction, too, in FIG. 2 via a one-way rotary clutch (not shown). The document separation means 42 prevents the feeding of two or more pieces of documents from the stack of documents placed on the document-placing plate means 18, and permits the conveyance of a document of the lowermost position only.

With reference to FIG. 2, a conveyer belt mechanism 48 is disposed under the document-placing plate means 18. The conveyer belt mechanism 48, which constitutes a conveyer means includes a driven roller 50 and follower rollers 52 which are arranged maintaining a distance in the direction of conveyance (right-and-left direction in FIG. 2), as well as an endless belt 54 wrapped around them. The lower running portion of the endless belt 54 extends along the transparent plate 8 of the electrostatic copying machine 2, and a document conveying passage 56 is defined between them. A document introduction passage 58 is formed between the document conveying passage 56 and the document-placing plate means 18. The document introduction passage 58 is defined between an inside guide plate 57 and outside guide plates 59 and 61. A pair of introduction rollers 66 are disposed in the document introduction passage 58. The pair of introduction rollers 66 together with the feed roller 36 and the document separation means 42 constitute a document introduction means which introduces the document on the document-placing plate means 18 onto the document conveying passage 56 through the document introduction passage 58. In the illustrated embodiment, a document inverting passage 60 is disposed on the left side of the document introduction passage 58 to invert the front side of the document introduced onto the document conveying passage 56 to the back. The document inverting passage 60 is defined between an inverting roller 62, which is rotated in the clockwise direction in FIG. 2, the inside guide plate 64 and the outside guide plates 68, 70, 72. The document inverting passage 60 has two rollers 62*a* and 62*b* that are so disposed as to come in contact with the inverting roller 62, respectively. The inverting roller 62 and the rollers 62*a*, 62*b* respectively, constitute a set of inverting rollers.

A document delivery passage 74 is disposed on the right side of the document conveying passage 56. The document delivery passage 74 is defined between an inside guide plate 76 and an outside guide plate 78. A document discharge port 80 is provided at a downstream end of the document delivery passage 74. The document delivery passage 74 is provided with pairs of delivery rollers 82 and 84 on the upstream side thereof and with a pair of document discharge rollers 86 near the document discharge port 80 which is at the downstream end. The pair of delivery rollers 82, pair of delivery rollers 84 and pair of document discharge rollers 86 constitute a document delivery means that delivers the document from the document conveying passage 56 onto the stationary plate 20 of the document-placing plate means 18 through the document delivery passage 74. Document Pushing-Down/Adjusting Mechanism:

The document conveying apparatus 4 constituted according to the present invention is equipped with a document pushing-down/adjusting mechanism 90 which is disposed at an upper position on the downstream side of the document discharge port 80, acts upon the rear end of the document on delivery after its rear end is substantially liberated from being nipped by the pair of document discharge rollers 86, and forcibly pushes the rear end of the document down toward the upstream end on the stationary plate 20 that constitutes the document-placing plate means 18, in order to hold the document for the stationary plate 20 for only a predetermined period of time.

Figure 8:
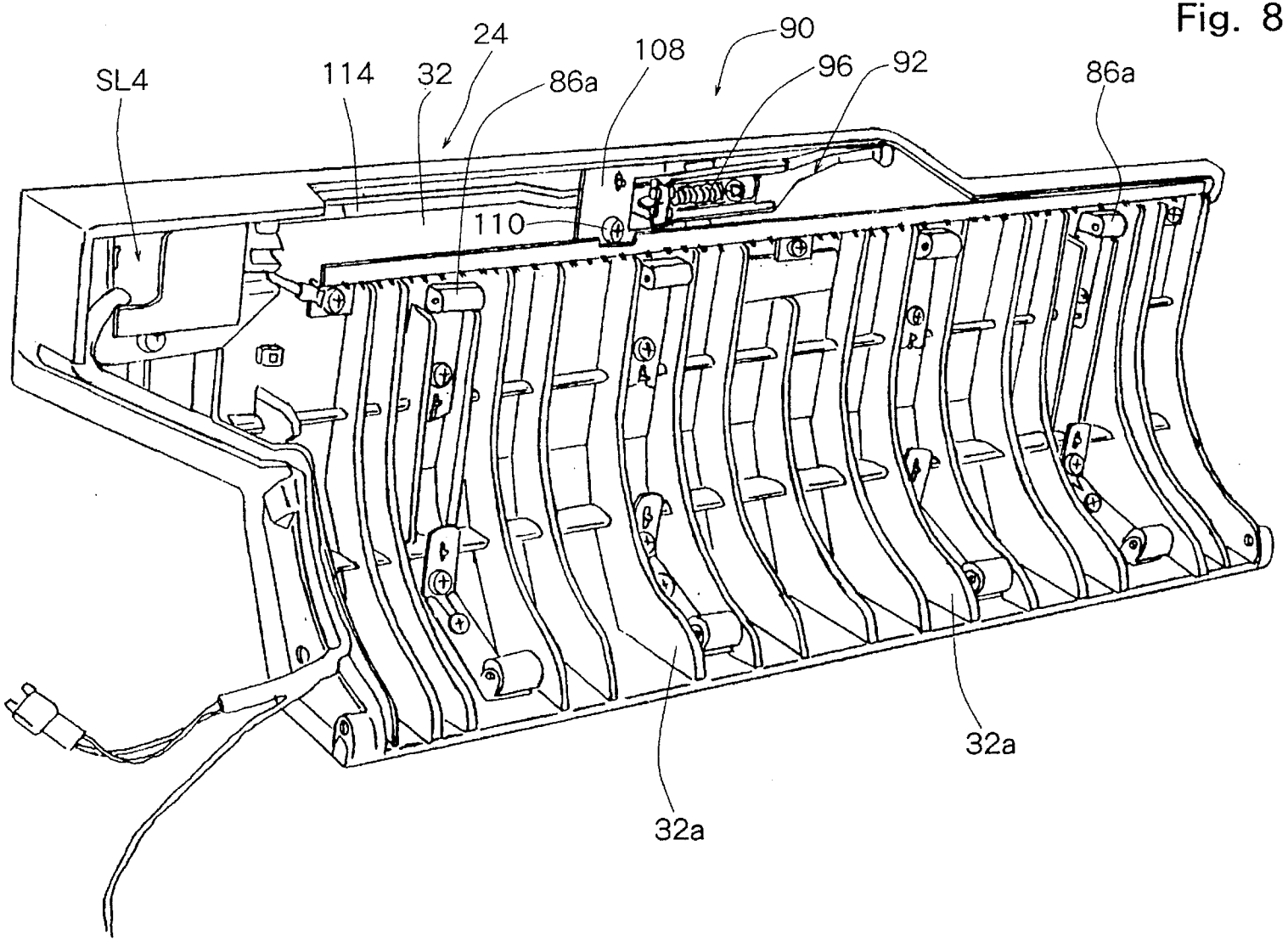
FIG. 8 is a perspective view which schematically illustrates a right end cover of the document conveying apparatus as viewed from the inside.

With reference to FIGS. 5 to 8, the upper wall portion 32 of the right end cover 24 of the document conveying apparatus 4 is located at a position on the downstream side of the document discharge port 80 to extend in the direction of width. The document pushing-down/adjusting mechanism 90 includes a lever member 92 (constituting a pushing-down lever means) that extends in the direction of width along the upper wall portion 32 and an electromagnetic solenoid SL4 that is provided on the upper wall portion 32 and is coupled to one end of the lever member 92. The lever member 92 is pivotably supported on the upper wall portion 32 with its one end as a fulcrum so as to move between a non-acting position at which the other end thereof is located at an upper position shown in solid line in FIG. 5, where it does not interfere with the document delivered from the document discharge port 80, and an acting position shown in a two-dot chain line in FIG. 5, at which the other end thereof is located on the upper surface of the stationary plate 20. Due to a tension coil spring 96 (constituting a spring means) provided between the upper wall portion 32 and the lever member 92, furthermore, the lever member 92 is urged at all times so as to be located at the non-acting position. When urged by the electromagnetic solenoid SL4, furthermore, the lever member 92 is rotated up to the acting position overcoming the force of the tension coil spring 96. After the lever member 92 is rotated to the acting position, the electromagnetic solenoid SL4 is energized for another predetermined period of time. Therefore, the other end of the lever member 92 acts on the rear end of the document on delivery after its rear end is substantially liberated from being nipped by the pair of document discharge rollers 86, and forcibly pushes down the rear end of the document toward the upper surface P at the upstream end position of the stationary plate 20. The lever member 92 continues to act for a predetermined period of time only, whereby the document is prevented from moving in the downstream direction, and the rear end of the document is adjusted at a predetermined position on the stationary plate 20. This operation is carried out every time a document is delivered from the document discharge port. Therefore, the documents are stacked at a predetermined position on the stationary plate 20 with their rear ends being adjusted. In FIG. 8, the end surfaces of a plurality of ribs 32*a* formed in the upper wall portion 32 constitute an outside guide plate 78 of the document delivery passage 74. Furthermore, the roller 86*a* provided under the upper wall portion 32 is one of the two rollers 86*a* and 86*b* that constitute the pair of document discharge rollers 86.

Figure 12:
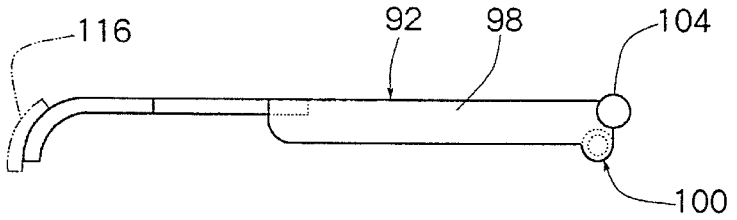
FIG. 12 is a side view of the lever member of FIG. 11.
Figure 13:
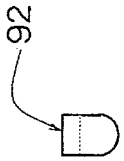
FIG. 13 is a view showing an end of the lever member of FIG. 11 as viewed from the left side.
Figure 14:
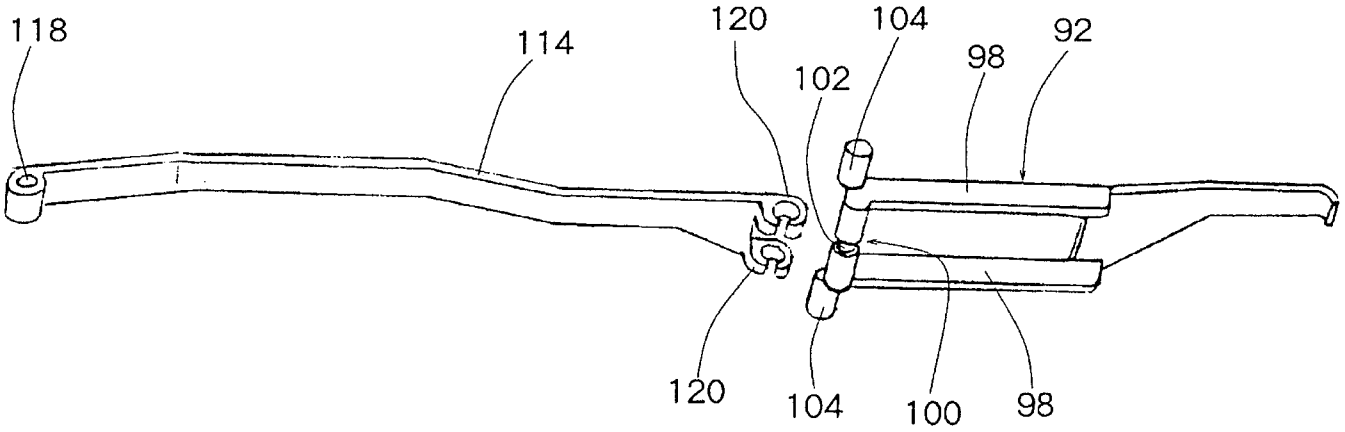
FIG. 14 is a perspective view illustrating the coupling lever and the lever member in a disassembled manner.
Figure 15:
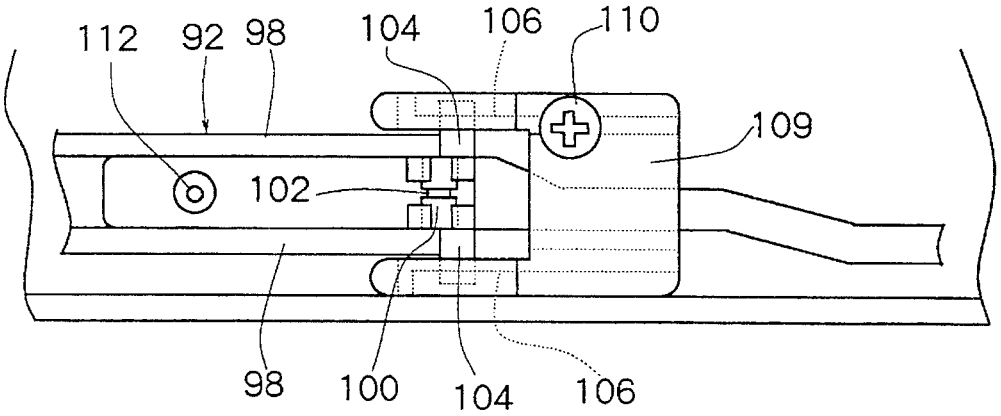
FIG. 15 is a partial view illustrating a coupling portion of the coupling lever and the lever member as viewed from the lower direction under the condition where the document pushing-down/adjusting mechanism is mounted on the upper wall portion of the right end cover.
Figure 16:
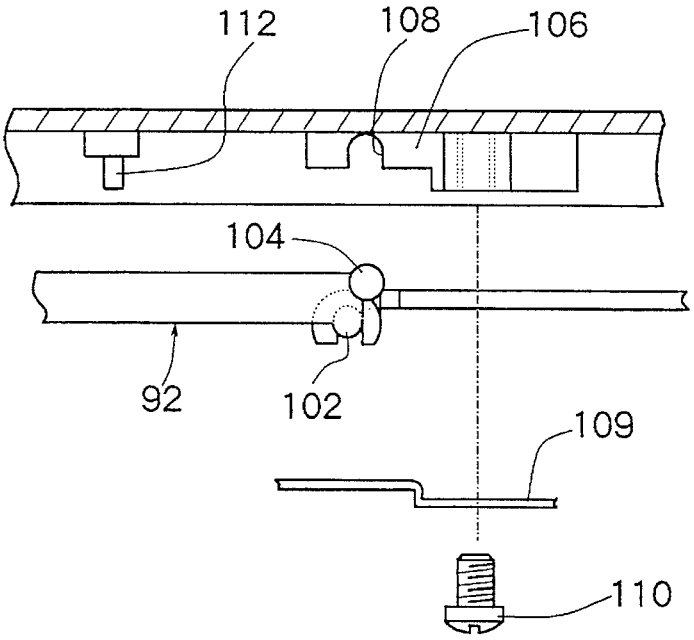
FIG. 16 is a side view of the coupling lever and lever member of FIG. 15 illustrated in a disassembled manner.

With reference to FIGS. 11 to 14, a pair of feet 98 extending maintaining a distance in parallel with each other in the lengthwise direction are formed at one end of the lever 92. A coupling pin 100 is provided across the lower ends of the feet 98 to couple them together. A small-diameter portion 102 is formed at a central portion of the coupling pin 100 in the axial direction. A pair of support pins 104 are provided, outwardly protruding from the ends of the feet 98 and arranged on the same axis. The support pins 104 are pivotably supported by the upper wall portion 32. That is, with reference to FIGS. 15 and 16, ribs 106 are formed, spaced from each other, on the lower surface of the upper wall portion 32, extending in the direction of width and downwardly protruding, and further having a recessed portion 108 formed therein, respectively. The bottom of the recessed portion 108 is of a semi-circular shape. The support pins 104 are pivotably inserted in the corresponding recessed portions 108. Under this condition, the lower surfaces of the ribs 106 are covered with a U-shaped plate member 109 which is attached by using a screw 110 that is screwed into a threaded hole formed in one rib 106. Tension spring 96 is disposed between the pair of feet 98, one end thereof being engaged with an engaging protrusion 112 formed on the upper wall portion 32 and the other end thereof being engaged with the small-diameter portion 102 of the coupling pin 100. The other end of the lever member 92 is bent in an arcuate form. As shown in FIG. 12, a synthetic rubber piece 116 (constituting a rubber means) is fitted to the other end of the lever member 92 to define the other end of the lever member 92. The coupling pin 100 extends along the lower surface of the upper wall portion 32 and is pivotably coupled at its one end to the other end of a coupling lever 114 that is coupled to the electromagnetic solenoid SL4.

Figure 5:
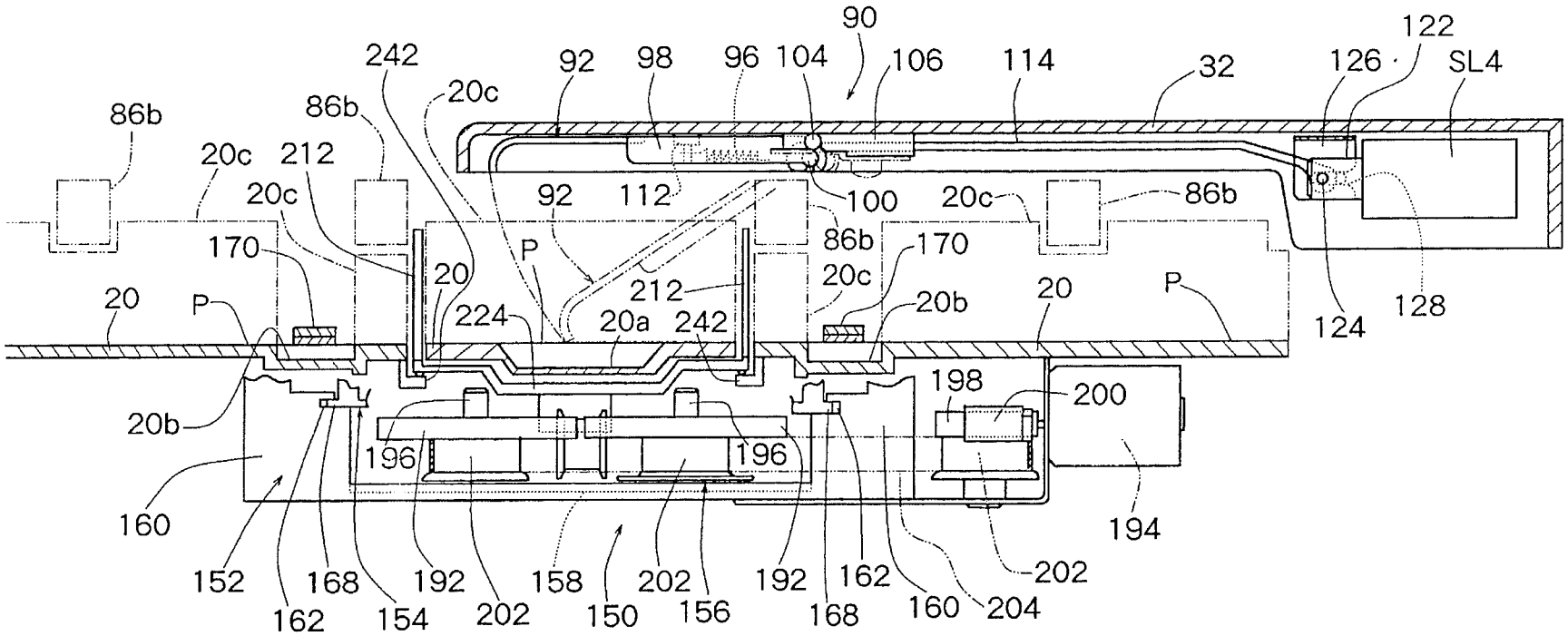
FIG. 5 is a sectional view which schematically illustrates an upstream end portion of the document conveying apparatus as viewed from the upstream side.
Figure 6:
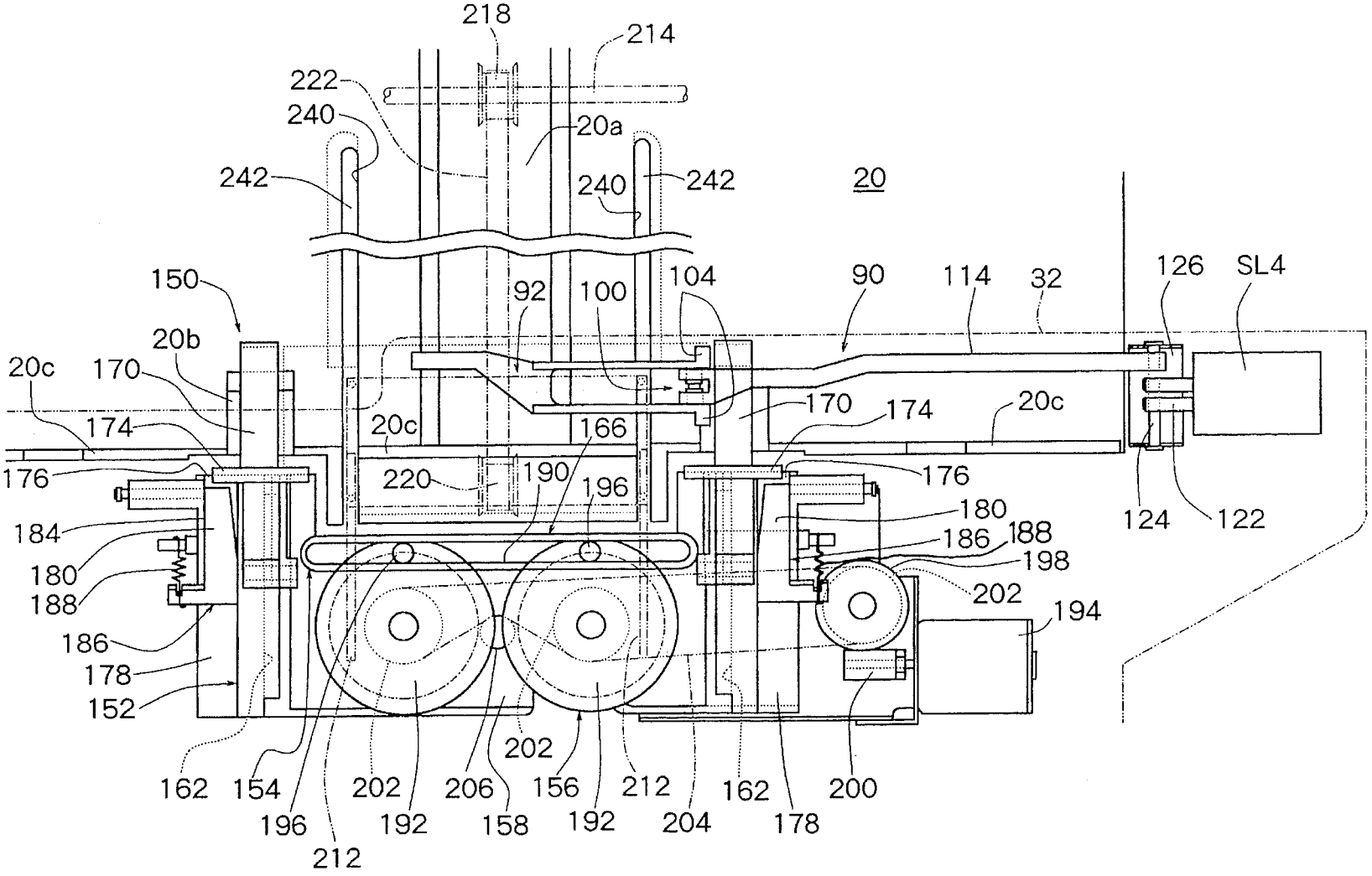
FIG. 6 is a schematic view which illustrates the upstream end portion of the document conveying apparatus as viewed from the upper side.
Figure 7:
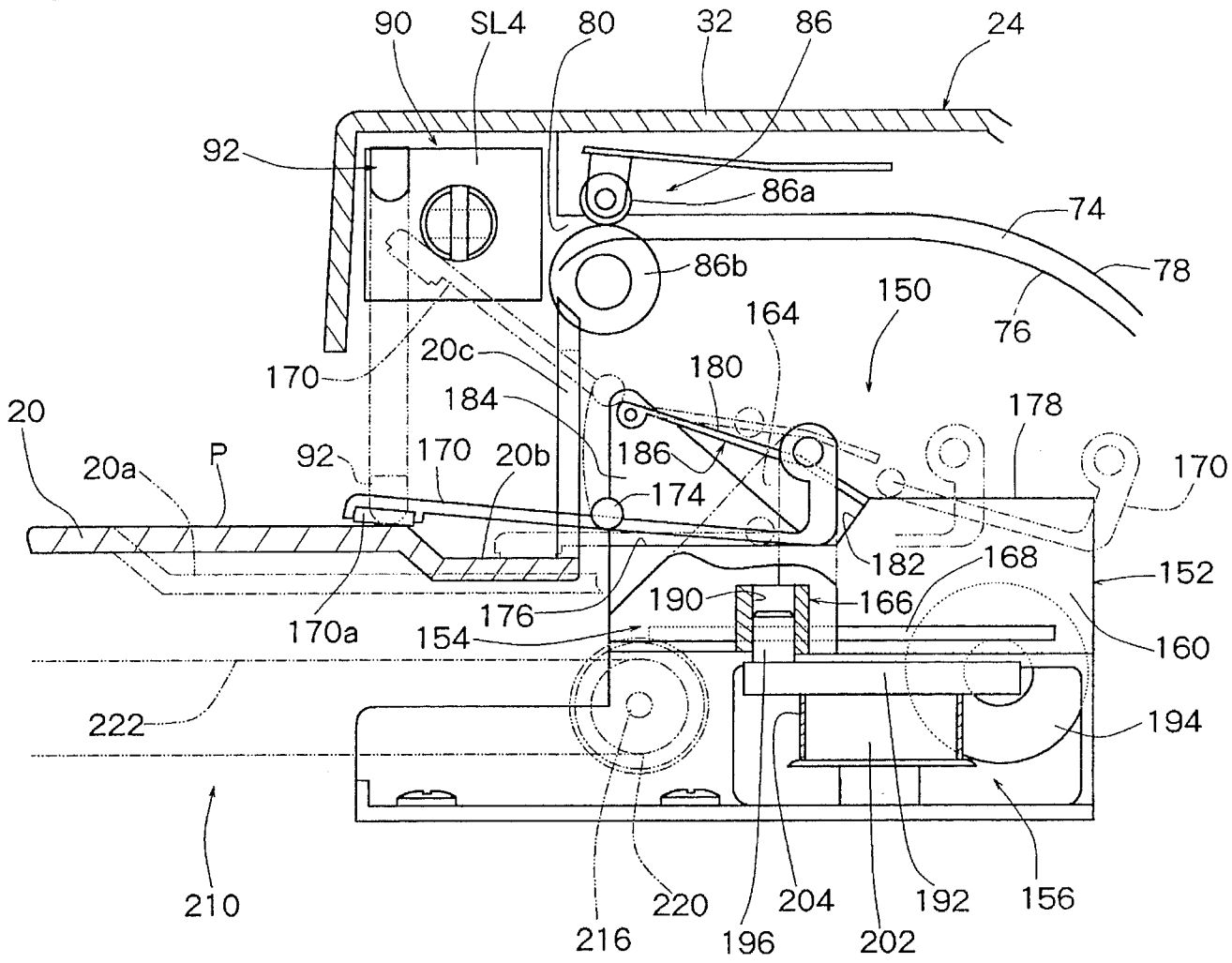
FIG. 7 is a schematic view which illustrates, partly in a cut-away manner, the upstream end portion of the document conveying apparatus as viewed from the side.
Figure 9:
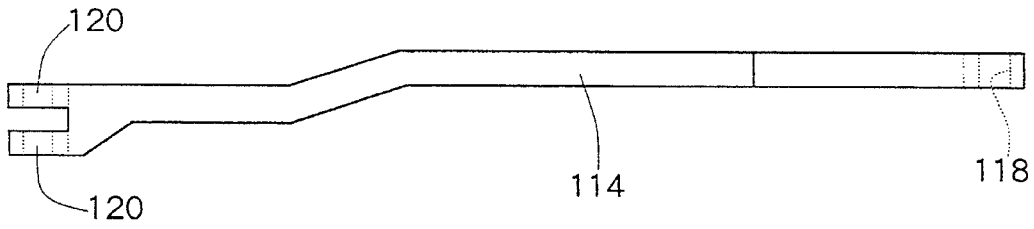
FIG. 9 is a top view of a coupling lever in a document pushing-down/adjusting mechanism.
Figure 10:
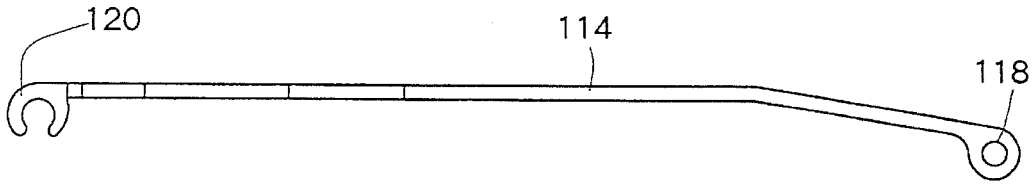
FIG. 10 is a side view of the coupling lever of FIG. 9.
Figure 11:
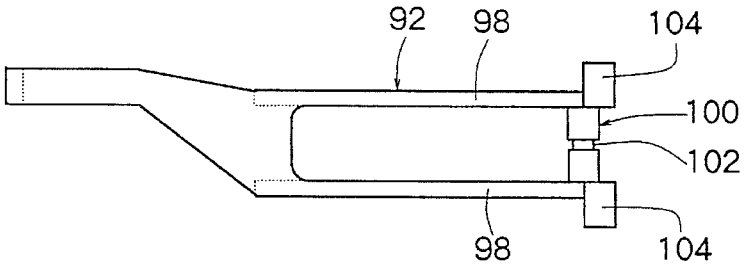
FIG. 11 is a top view of a lever member in the document pushing-down/adjusting mechanism.

With reference to FIGS. 9 and 10, a hole 118 is formed in one end of the coupling lever 114, and a pair of grip portions 120 are formed at the other end thereof maintaining a distance in the lateral direction. The grip portions 120 have an arcuate shape with their lower ends being cut away and are fitted at the arcuate portion to the coupling pin 100 to rotate relative thereto. With reference to FIG. 6, a pin 124 is inserted between the hole 118 of the coupling lever 114 and an output rod 122 of the electromagnetic solenoid SL4, so that an end of the coupling lever 114 is operably coupled to the electromagnetic solenoid SL4. The pin 124 is so supported as to move along an elongated hole 128 of a support plate 126 provided on the upper wall portion 32 (see FIG. 5). With reference to FIG. 5, when the electromagnetic solenoid SL4 is energized, the coupling lever 114 moves rightwards and the coupling pin 100 of the lever member 92 moves rightwards, whereby the lever member 92 turns in the counterclockwise direction with the support pin 104 as a fulcrum and is brought to the acting position (see two-dot chain line in the drawing). When the electromagnetic solenoid SL4 is de-energized, the lever member 92 turns in the clockwise direction with the support pin 104 as a fulcrum due to the resilient force of the tension coil spring 96, and is returned back to the non-acting position indicated by a solid line in the drawing. A recessed portion **20*a* is formed in the upper surface P of the stationary plate 20 which comes into contact with the other end of the lever member 92, the recessed portion 20*a* being lower than the upper surface P. At the acting position, therefore, the other end of the lever member 92 drops down to a level which is substantially the same as the upper surface P of the stationary plate 20**, but does not come into direct contact with the upper surface P.

Figure 17:
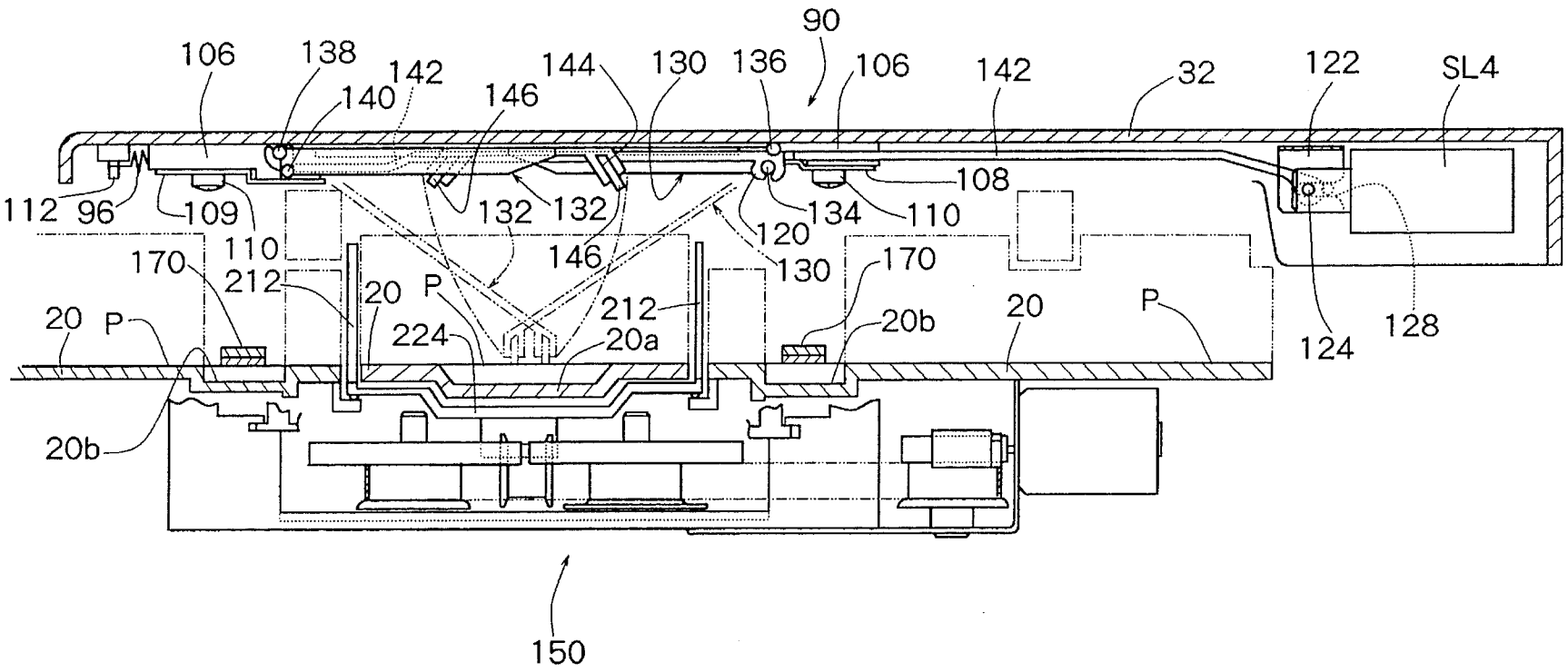
FIG. 17 is a sectional view which schematically illustrates an upstream end portion of the document conveying apparatus equipped with the document pushing-down/adjusting mechanism of another embodiment as viewed from the upstream side, and chiefly illustrates the document pushing-down/adjusting mechanism.
Figure 18:
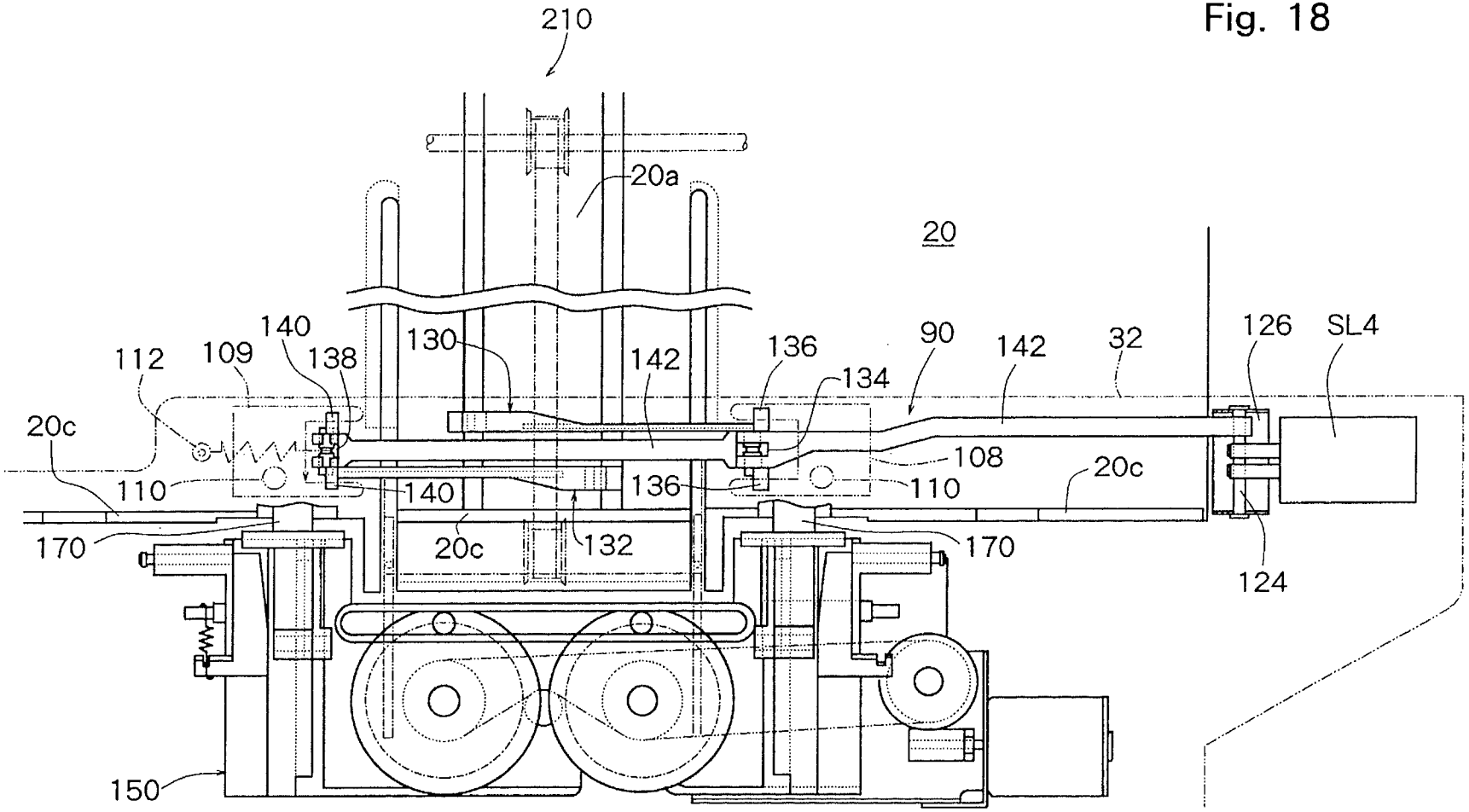
FIG. 18 is a schematic view illustrating, partly in a cut-away manner, the mechanism of FIG. 17 as viewed from the upper side.
Figure 19:
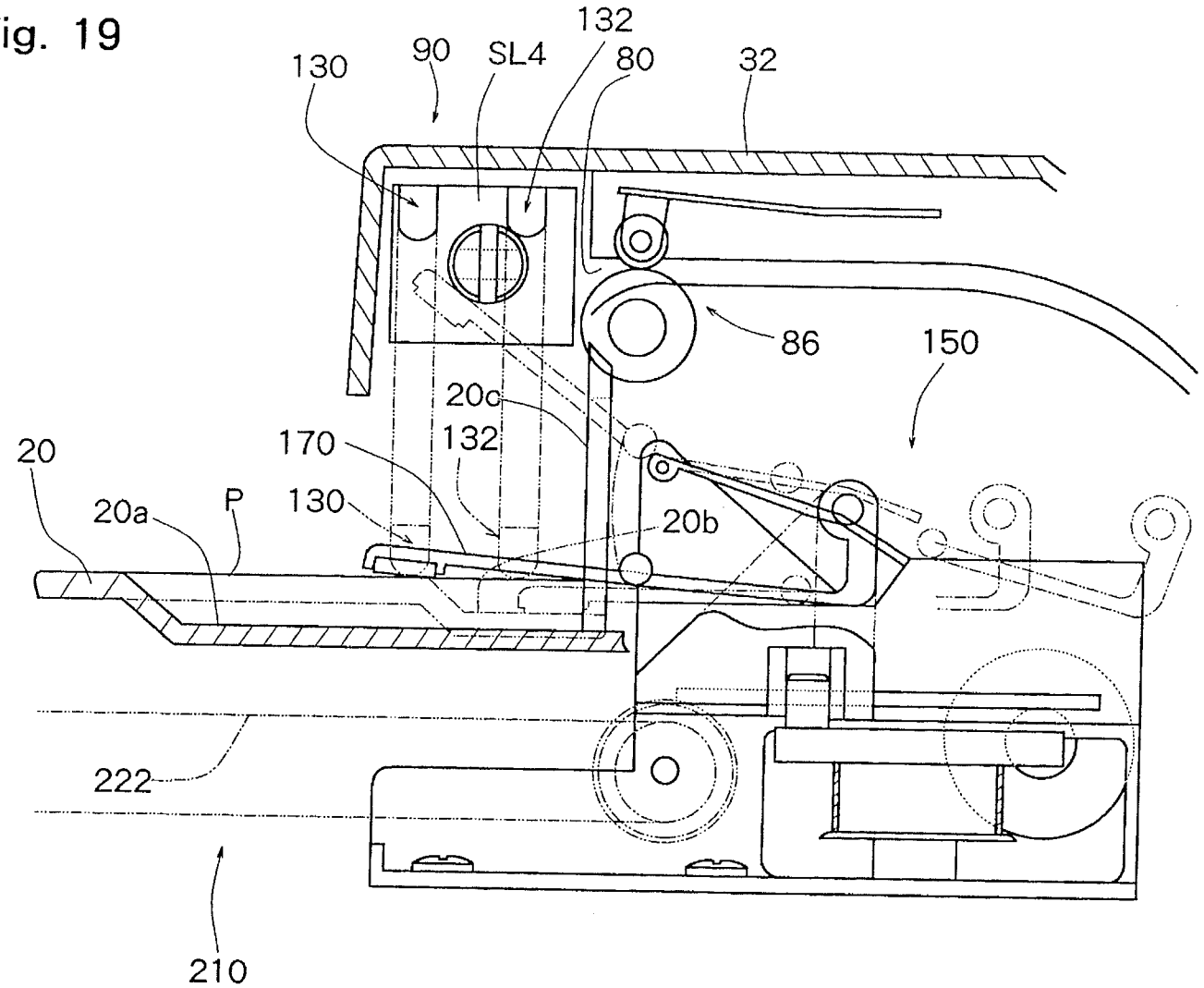
FIG. 19 is a schematic view of the mechanism of FIG. 17 as viewed from the side direction.

FIGS. 17 to 19 illustrate an embodiment in which a push-down lever means in the document pushing-down/adjusting mechanism 90 is constituted by two lever members. The two lever members are arranged extending in parallel in the direction of width maintaining a distance in the direction in which the delivered document moves, supported by the upper wall portion 32 to turn in opposite directions relative to each other with their ends on one side thereof as fulcrums. The lever members are coupled at their ends on one side thereof to the electromagnetic solenoid SL4 so as to move substantially simultaneously between the non-acting position shown in solid lines in FIG. 17 and the acting position shown in two-dot chain lines in FIG. 17. The two lever members consist of a first lever member 130 of which the first end is positioned on the side of the electromagnetic solenoid SL4 and a second lever member 132 of which the first end is positioned on the side opposite to the electromagnetic solenoid SL4. Under the first end of the first lever member 130 is provided a first coupling pin 134 that protrudes outwardly on one side thereof. A pair of first support pins 136 are provided above both ends of the first coupling pin 134, the pair of first support pins 136 outwardly protruding from both ends of the first coupling pin 134 and arranged on the same axis. A second coupling pin 138 is provided above the first end of the second lever member 132, outwardly protruding toward a direction opposite to the first coupling pin 134. A pair of second support pins 140 are provided under both ends of the second coupling pin 138, outwardly protruding from both ends of the second coupling pin 138 and arranged on the same axis. As will be obvious from the drawing, the first coupling pin 134 and the second coupling pin 138 of the first and second lever members 130 and 132 are constituted in the same manner as the coupling pin 100 of the aforementioned embodiment, and the first support pin 136 and the second support pin 140 are constituted in the same manner as the support pin 104 of the aforementioned embodiment. The first and second support pins 136 and 140 are pivotably supported by the upper wall portion 32. This rotary support mechanism is constituted in the same manner as that of the aforementioned embodiment, and substantially the same portions are denoted by the same reference numerals but are not described here again.

The first coupling pin 134 extends along the upper wall portion 32 and is pivotably coupled at its one end to an intermediate portion of the coupling lever 142 that is coupled at its first end to the electromagnetic solenoid SL4. The second coupling pin 138 is pivotably coupled to the other end of the coupling lever 142 that extends from the intermediate portion, passing between the first and second lever members 130 and 132. The portion where the coupling lever 142 is coupled to the first coupling pin 134 and the second coupling pin 138, respectively, is constituted in the same manner as the portion where the coupling lever 114 is coupled to the coupling pin 100 in the aforementioned embodiment. Therefore, substantially the same portions are denoted by the same reference numerals but are not described here again. Moreover, the portion where the coupling lever 142 and the electromagnetic solenoid SL4 are coupled together is constituted in the same manner as that of the aforementioned embodiment, and is not described here. Referring here to FIG. 17, the tension coil spring 96 is provided between the small-diameter portion of the second coupling pin 138 and the engaging protrusion 112 provided on the upper wall portion 32. Referring to FIG. 17, furthermore, grooves 144 are formed in the ends on the other side of the first and second lever members 130 and 132, and a downwardly protruding synthetic rubber piece 146 (constituting a rubber means) is fitted in the grooves 144. With reference to FIG. 17, when the electromagnetic solenoid SL4 is energized, the coupling lever 142 moves rightwards causing the coupling pins 134 and 138 of the first and second lever members 130 and 132 to simultaneously move toward the right. Therefore, the first lever member 130 turns in the counterclockwise direction with the support pin 136 as a fulcrum, and the second lever member 132 turns in the clockwise direction with the support pin 140 as a fulcrum, whereby these lever members are simultaneously brought to their acting positions (see two-dot chain line of FIG. 17). When the electromagnetic solenoid SL4 is de-energized, the first lever member 130 turns in the clockwise direction and the second lever member 132 turns in the counterclockwise direction due to the resilient force of the tension coil spring 96 and are returned back to the non-acting positions indicated by solid lines in FIG. 17. The lever member 92, coupling lever 114, first and second lever members 130 and 132, and coupling lever 142 in the document pushing-down/adjusting mechanism 90 can be made of a suitable synthetic resin such as polyacetal.

With reference to FIG. 5, when the delivered document is pushed down by the lever member 92, the document tends to be displaced toward the direction of width (rightwards in the drawing) on the stationary plate 20. When the delivered document is pushed down by the two lever members 130 and 132 turning in the opposite directions, as will be easily understood from FIG. 17, however, the components of force that displace the document in the direction of width act upon each other in the opposite directions so that the components of force are canceled by each other. As a result, the document is located at a predetermined position on the stationary plate 20 without being displaced in the direction of width.

Document Drawing/Adjusting Mechanism:

With reference to FIGS. 5 to 7 and 20, the document conveying apparatus 4 is equipped with a document drawing/adjusting mechanism 150 which pushes from the upper side the rear end of the document that has been delivered onto the stationary plate 20 through the document delivery passage 74, further draws the document up toward the upstream direction, and holds the document for a predetermined period of time. The document drawing/adjusting mechanism 150 includes a support plate means 152 provided at a position on the upstream side of the stationary plate 20, a moving body means 154 which is supported on the support plate means 152 to reciprocatingly move in the direction in which the delivered document moves, and a drive means 156 which is provided on the support plate means 152 and reciprocatingly moves the moving body means 154. The support plate means 152 includes a base 158 having a nearly rectangular plane and a pair of support plates 160 which are formed maintaining a distance in the direction of width and have substantially the same constitution. As shown in FIG. 5, at the inside positions of the opposing support plates 160 are provided guide grooves 162 (constituting guided-rail means) that have substantially the same constitution and that extend in the direction in which the delivered document moves. The guide grooves 162 have the shape of a channel with their opposing portions opened. The moving body means 154 has moving bodies 164 disposed maintaining a distance in the direction of width, and a coupling member 166 for coupling the moving bodies 164. The moving body 164 is of a right-angled triangular shape with its vertex located on the upstream side, and has protrusions 168 (constituting guide rail means) on the outer sides in the direction of width thereof that move, being fitted, to the guide grooves 162.

Figure 20:
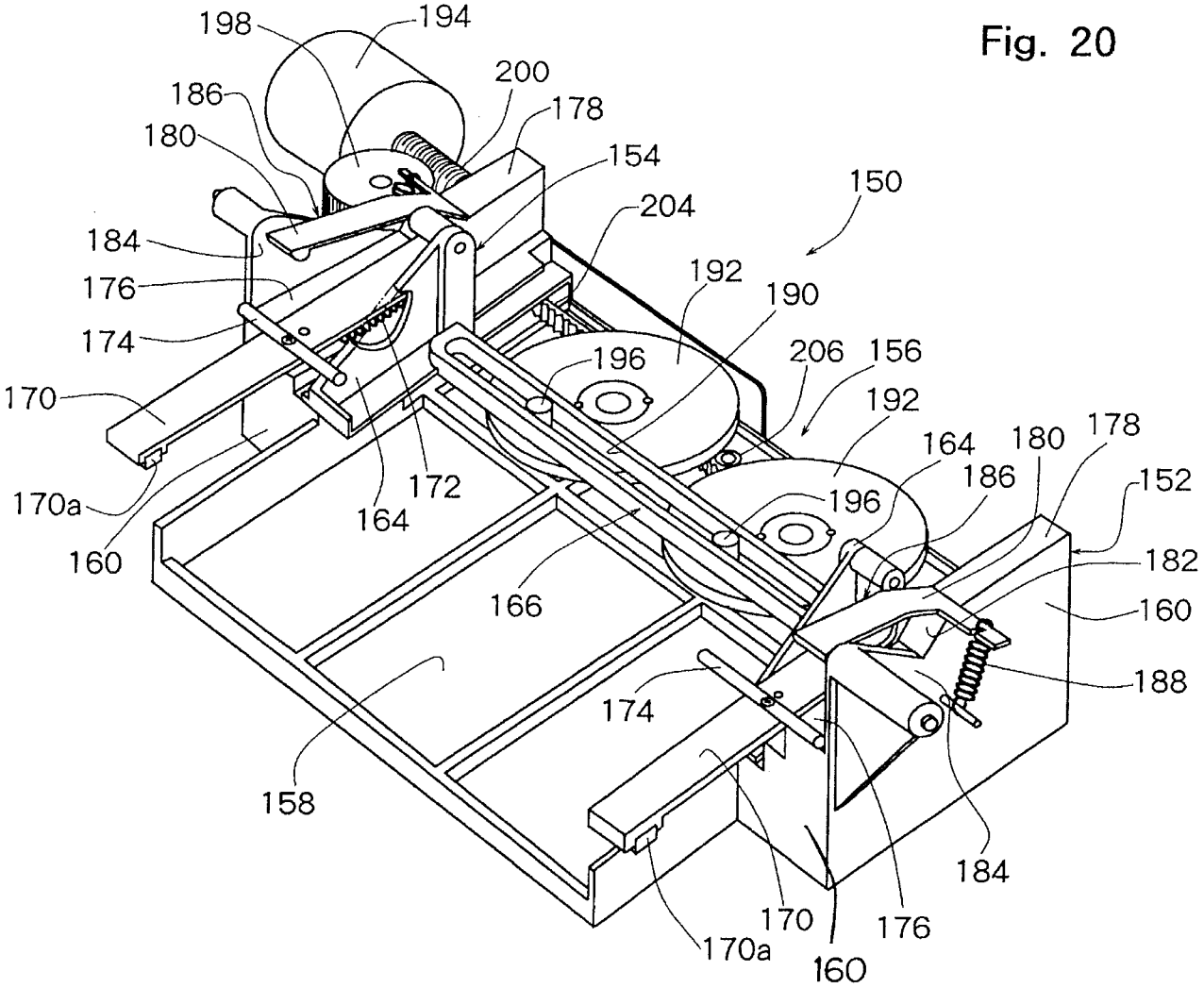
FIG. 20 is a perspective view which schematically illustrates a document drawing/adjusting mechanism.

Drawing levers 170 (constituting drawing lever means), which are constituted substantially in the same manner, are pivotably supported on the outer sides of the moving bodies 164 in the direction of width thereof. The drawing levers 170 extend in the direction in which the delivered document moves, and the upwardly extending ends thereof on the upstream side are pivotably supported at the vertexes of the moving bodies 164. As shown in FIG. 20, the drawing levers 170 are always urged in a manner that the downstream ends thereof downwardly turn due to the tensile coil spring 172 (constituting a spring means) that is provided between the drawing lever and the moving body 164. A synthetic rubber piece 170*a* (constituting rubber means) of a rectangular shape is fitted to the lower surface of the downstream end of each of the drawing levers 170 to define the lower surface thereof. The drawing levers 170 have a guide pin 174 (constituting guide pin means) that outwardly protrudes from one side thereof. The guide pins 174 are pushed onto a guide plane means, that is provided on the support plates 160 and will be described later, by the tension coil spring 172, and are allowed to move along therewith.

Each of the support plates 160 has a guide plane means provided on one outer side of the drawing lever 170 and extending in parallel therewith. That is, the guide plane means of each of the support plates 160 has a downstream-side guide plane 176 which is in parallel with the upper surface P of the stationary plate 20, an upstream-side guide plane 178 formed continuously to the downstream-side guide plane 176, and a tilted guide plane 180 that rises toward the downstream direction from the downstream end of the upstream-side guide plane 178. Each of the guide plane means has substantially the same constitution, and only one of them is described here. The upstream-side guide plane 178, which is in parallel with the upper surface P of the stationary plate 20, is formed at a position higher than the downstream-side guide plane 176, and the upstream-side guide plane 178 and the downstream-side guide plane 176 are connected together via a tilted guide plane 182. On the outer side of the downstream-side guide plane 176 of the support plate 160 is formed a right-angled triangular support portion 184 having a vertex on the downstream side. At the vertex of the support portion 184 is pivotably supported the downstream end portion of a tilted lever member 186. The tilted guide plane 180 is constituted by the upper surface of the tilted lever member 186 which is positioned at right angles over the downstream-side guide plane 176. Therefore, the tilted guide plane 180 is positioned at right angles over the downstream-side guide plane 176 maintaining a distance. The tilted lever member 186 is always so urged that the upstream end portion thereof comes in contact with the upstream-side guide plane 178 due to the action of a tension coil spring 188 (constituting a spring means) provided between it and the support portion 184. Here, the guide plane means may be constituted by the downstream-side guide plane 176 and the tilted guide plane 180. In this case, the tilted lever member 186 has an increased length in order to prevent the tilted guide plane 180 from being steeply tilted, and the upstream end portion thereof comes in contact with an upstream side position of the downstream-side guide plane 176.

The coupling member 166 coupling the moving bodies 164 is provided with a guide groove 190 (constituting a guide groove means) which linearly extends in the direction of width and is opened at least in the lower portion thereof. In this embodiment, the guide groove 190 is constituted by an elongated hole. The drive means 156 includes two rotary disks 192 which have substantially the same constitution and are supported on base 158 under the guide groove 190, and an electric motor 194 (constituting a draw drive means) which drives the rotary disks 192 in synchronism with each other. The rotary disks 192 are provided with pin members 196 that upwardly protrude. The pin members 196 are allowed to move relative to each other along the guide groove 190. Hence, the revolutions of the rotary disks 192 are converted into reciprocating motions of the moving body means 154. On one side portion of the base 158 are disposed the electric motor 194 and a worm wheel 198. A worm gear 200 is fitted to the drive shaft of the electric motor 194. The worm wheel 198 is in mesh with the worm gear 200, and hence is driven by the electric motor 194. The rotary disks 192 and the worm wheel 198 are provided with toothed pulleys 202 that rotate together with them. A toothed belt (endless belt) 204 is wrapped around the toothed pulleys 202. The tension of the toothed belt 204 is adjusted by an idle roller 206. The worm wheel 198 rotates with the rotation of the electric motor 194. The rotation of the worm wheel 198 is transmitted, via the toothed belt 204, to the two rotary disks 192 in synchronism. Therefore, the rotary disks 192 are simultaneously rotated in the same direction. The moving body means 154 moves reciprocatingly as the pin members 196 move relative to each other along the guide groove 190 when the rotary disks 192 rotate. A single rotary disk 192 may be provided The standby position (home position) of the moving body means 154 is defined between the downstream end position and the upstream end position of the range of reciprocating motion. When the pin members 196 are located at the most downstream position shown in FIG. 6, the moving body means 154 is brought to the downstream end position. When the pin members 196 are located at the most upstream position which is turned by 180° from the most downstream position shown in FIG. 6, the moving body means 154 is brought to the upstream end position. When the moving body means 154 is brought to the standby position which is defined on the upstream side separated away by a predetermined distance from the downstream end position, the guide pin 174 of the drawing lever 170 is brought in contact with a guide standby position on the upstream side from the downstream end of the downstream-side guide plane 176. This guide standby position corresponds to the position of the guide pin 174 indicated by a two-dot chain line on the downstream side guide plane 176 of FIG. 7. When the moving body means 154 is moved from the standby position to the upstream end position, the upstream end portion of the tilted lever member 186 is pushed up against the resilient force of the tension coil spring 188 due to the movement of the guide pin 174. As a result, the guide pin 174 is allowed to move from the downstream-side guide plane 176 to the upstream-side guide plane 178.

The position of the downstream end of the titled guide plate 180 and the position of the downstream end of the downstream-side guide plane 176 are so defined that the guide pin 174 that upwardly moves in the downstream direction from the upstream-side guide plane 178 along the titled guide plane 180, is brought to the downstream end of the downstream-side guide plane 176 from the downstream end of the tilted guide plane 180, i.e., from the downstream end of the tilted lever member 186, when the moving body means 154 is moved from the upstream end position to the downstream end position. The downstream end position of the guide pin 174 is indicated by a solid line in FIGS. 6 and 7. When the moving body means 154 is moved from the downstream end position to the standby position, the guide pin 174 moves to the above-mentioned guide standby position from the downstream end of the downstream-side guide plane 176.

When the moving body means 154 is moved to the downstream end position, the lower surface of the downstream end portion of the drawing lever 170 descends down to a draw start position that is downstream from the upstream end of the stationary plate 20, and is pushed to the upper surface P of the stationary plate 20. This pushing operation is produced by the tension coil spring 172. The draw start position of the drawing lever 170 is indicated by a solid line in FIGS. 6 and 7. When the moving body means 154 is brought to the standby position, the downstream end portion of the drawing lever 170 is brought to a holding standby position which is slightly downstream from the upstream end of the stationary plate 20, but upstream from the draw start position. The holding standby position at the downstream end portion of the drawing lever 170 is indicated by a two-dot chain line in FIG. 7.

At the holding standby position of the drawing lever 170, the upper surface of the stationary plate 20 on which the downstream end portion of the drawing lever 170 is positioned, is formed to be lower than the upper surface P at the draw start position. Concretely speaking, the recessed portion **20*b* is formed in the above portion of the stationary plate 20. The recessed portion 20*b* is formed in order that the document delivered onto the stationary plate 20 is easily and reliably drawn by the lower surface of the downstream end portion of the drawing lever 170. The upstream end of the stationary plate 20 is defined by a plurality of end walls 20*c* that upwardly extend from the upper surface P of the stationary plate 20. The end walls 20*c* are so positioned as will not interfere with the reciprocating movement of the moving body means 154 inclusive of the drawing lever 170, and are arranged at upper positions neighboring the downstream end portion of the drawing lever 170 that is located at said holding standby position. The holding of delivered document by the document drawing/adjusting mechanism 150 is controlled to be continued for a predetermined period of time inclusive of a period in which the document placed on the stationary plate 20 is at least introduced into the document introduction passage 58 by the feed rollers 36**.

After the document is delivered from the document discharge port 80 onto the stationary plate 20, the downstream end of the drawing lever 170 brought from the holding standby position to the downstream end position is descended on the rear end portion of the document and is located at the draw start position. Therefore, the rear end portion of the document is pushed onto the stationary plate 20 by the lower surface at the downstream end of the drawing lever 170. Then, while the drawing lever 170 is being moved to the holding standby position in the upstream direction, the rear end portion of the document is moved toward the upstream direction of the stationary plate 20 by the lower surface at the downstream end of the drawing lever 170. As the drawing lever 170 that has moved to the holding standby position discontinues to move, the rear end of the document is brought into contact with the end walls **20*c* that define the upstream end of the stationary plate 20 and is adjusted for its position. The above-mentioned operation is executed every time a document is delivered from the document discharge port 80 onto the stationary plate 20. Therefore, the delivered documents are adjusted in a stacked state at the upstream end position on the stationary plate 20**.

The base 158, pair of support plates 160, tilted lever members 186 provided for the pair of support plates 160, moving bodies 164, coupling member 166 coupling the moving bodies 164, drawing levers 170, guide pins 174 provided on the drawing levers 170 and rotary disks 192 in the document drawing/adjusting mechanism 150 can be made of a suitable synthetic resin such as a polycarbonate.

Figure 21:
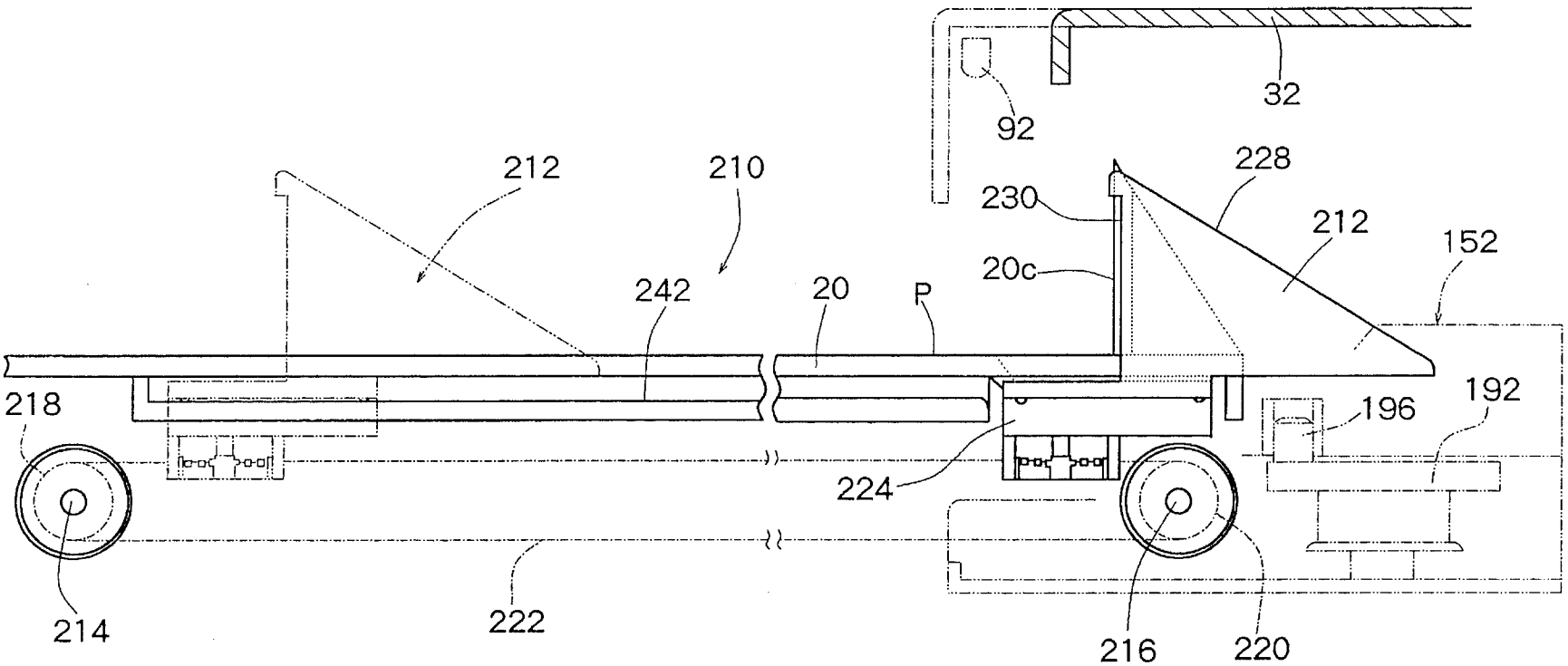
FIG. 21 is a side view which schematically illustrates a document transfer mechanism.
Figure 22:
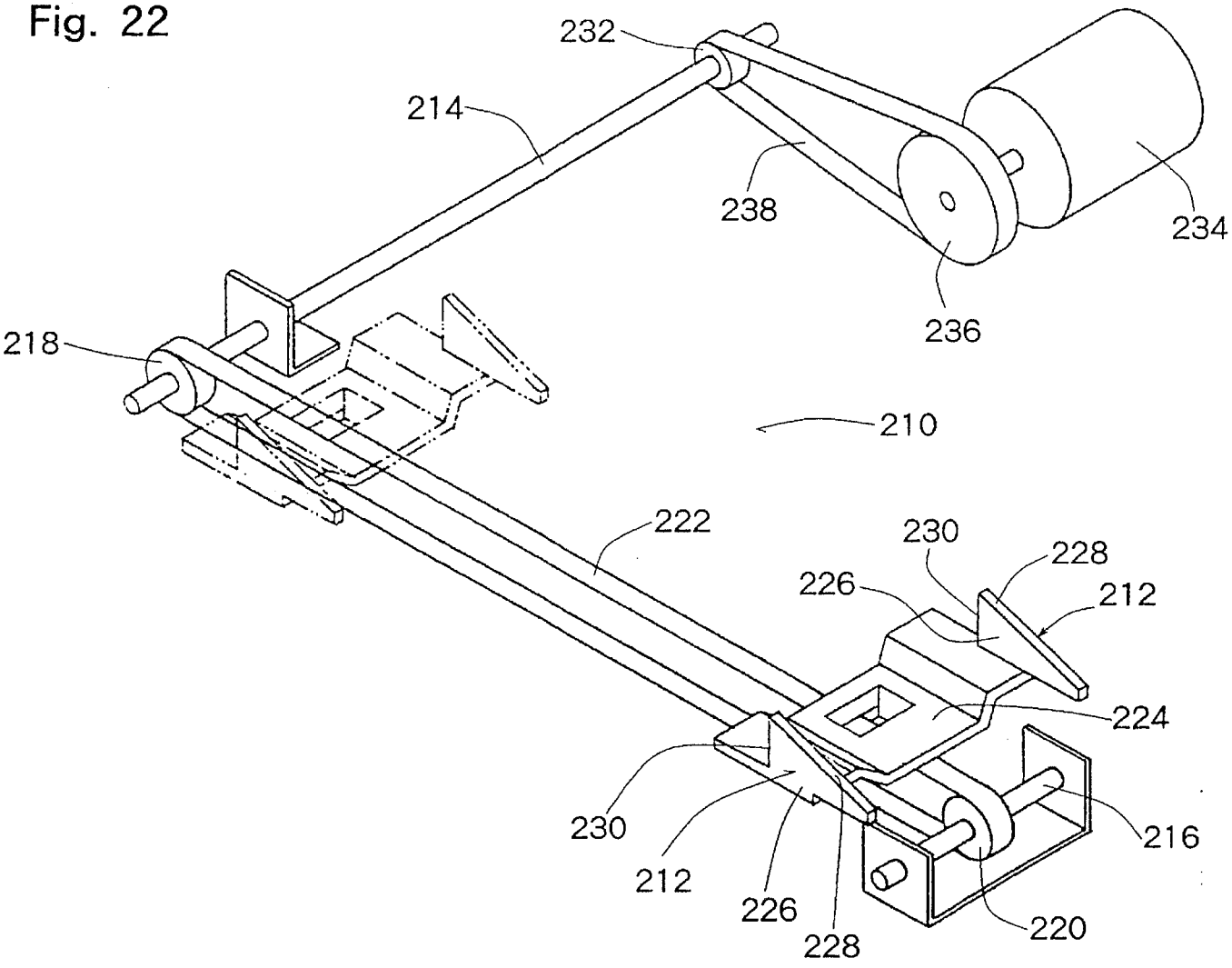
FIG. 22 is a perspective view of the document transfer mechanism.

Document Transfer Mechanism:

In the document conveying apparatus 4 there is disposed a document transfer mechanism 210. As shown in FIG. 2, the document transfer mechanism 210 is disposed under the stationary plate 20. With reference to FIGS. 21 and 22, the document transfer mechanism 210 has two protruding members 212 (constituting a protrusion means) that reciprocatingly move between a retracted position located more on the upstream side than the upstream end of the stationary plate 20 and an advanced position located toward the downstream side by a predetermined distance from the retracted position, the protruding members upwardly protruding beyond the surface P of the stationary plate 20. The document transfer mechanism 210 disposed under the stationary plate 20 includes a driven shaft 214 and a follower shaft 216 that are both rotatably mounted, maintaining a distance in the direction of conveying the document. A toothed pulley 218 is fitted to one end of the driven shaft 214 and, similarly, a toothed pulley 220 is fitted to the follower shaft 216. A toothed belt (endless belt) 222 is wrapped around the pair of toothed pulleys 218 and 220. The protruding members 212 are fitted to the upper running portion of the toothed belt 222. The protruding members 212 have a base portion 224 fitted to the toothed belt 222 and two protruding main portions 226 that upwardly protrude from the base portion 224 and maintain a distance from each other in the direction of width. It is desirable that the tilted surfaces 228 on the upstream side (right, upper surfaces in FIGS. 21 and 22) of the protruded main portions 226 of the protruding members 212 be upwardly tilted toward the downstream at a relatively moderate angle which may be, for example, about 45 degrees. It is preferable that upright wall surfaces 230 which are substantially vertical be formed on the downstream side (left side in FIGS. 21 and 22) of the protruding main portions 226 of the protruding members 212. Another toothed pulley 232 is fitted to the other end of the driven shaft 214. An electric motor 234 (constituting a transfer drive source) is disposed in relation to the driven shaft 214, and a toothed pulley 236 is fitted to an output shaft of the electric motor 234. A toothed belt (endless belt) 238 is wrapped around the toothed pulleys 232 and 236. Thus, the driven shaft 214 is drivably coupled to the electric motor 234. The toothed belt 222 is driven by suitably rotating the driven shaft 214 in the forward direction and in the reverse direction by means of the electric motor 234, whereby the protruding members 212 are reciprocatingly moved between the retracted position indicated by a solid line and the advanced position indicated by a two-dot chain line in FIGS. 21 and 22.

As will be understood with reference to FIGS. 1 and 6, two slits 240 are formed in the stationary plate 20 extending in the direction of conveyance and maintaining a distance in the direction of width (direction perpendicular to the surface of the paper in FIG. 2). At the retracted position, the protruding member 212 is located slightly on the upstream side of the end wall 20*c* defining the upstream end of the stationary plate 20 (see also FIG. 21). When the protruding member 212 proceeds from the retracted position toward the downstream direction, the protruding main portion 226 of the protruding member 212 upwardly protrudes through the slit 240 in the stationary plate 20 and is advanced maintaining this condition. Then, the upright wall surface 230 of the protruding main portion 226 acts upon the rear edge of the documents which have been delivered from the document discharge port 80 and stacked and of which the rear edges are positioned on the stationary plate 20, and thus the stack of documents is advanced toward the downstream direction.

When the documents which are relatively long in the direction of conveyance are placed in a stacked state on the stationary plate 20, and a document at the lowermost position of the stack is delivered from the document conveying passage 56 through the document delivery passage 74 and discharged onto the stationary plate 20, the protruding main portion 226 of the protruding member 212 is brought in contact with the rear end, or close to the rear end, of the documents that are placed in a stacked state waiting to be fed, and the discharged document gets over the protruding main portion 226 of the protruding member 212 and is advanced to the upper portion of the stack of documents. The thickness of the stack of documents placed on the stationary plate 20 is limited to be smaller than the height of the protruding main portion 226 of the protruding member 212, i.e., limited to be smaller than the height of protrusion which protrudes beyond the upper surface P of the stationary plate 20. Therefore, the document that is discharged from the document discharge port 80 is advanced over the protruding main portion 226 of the protruding member 212, and is placed at the uppermost position of the stack of documents placed on the stationary plate 20, thus being reliably prevented from mixing into the stack of documents. The advanced position of the protruding main portion 226 of the protruding member 212 is suitably selected in advance depending upon the length of the document. Referring to FIGS. 5 and 6, a receiving plate 242 is formed under the slits 240 along therewith. Both ends of the base portion 224 are supported by the receiving plate 242 so as to slide along the upper surface thereof.

Figure 24:
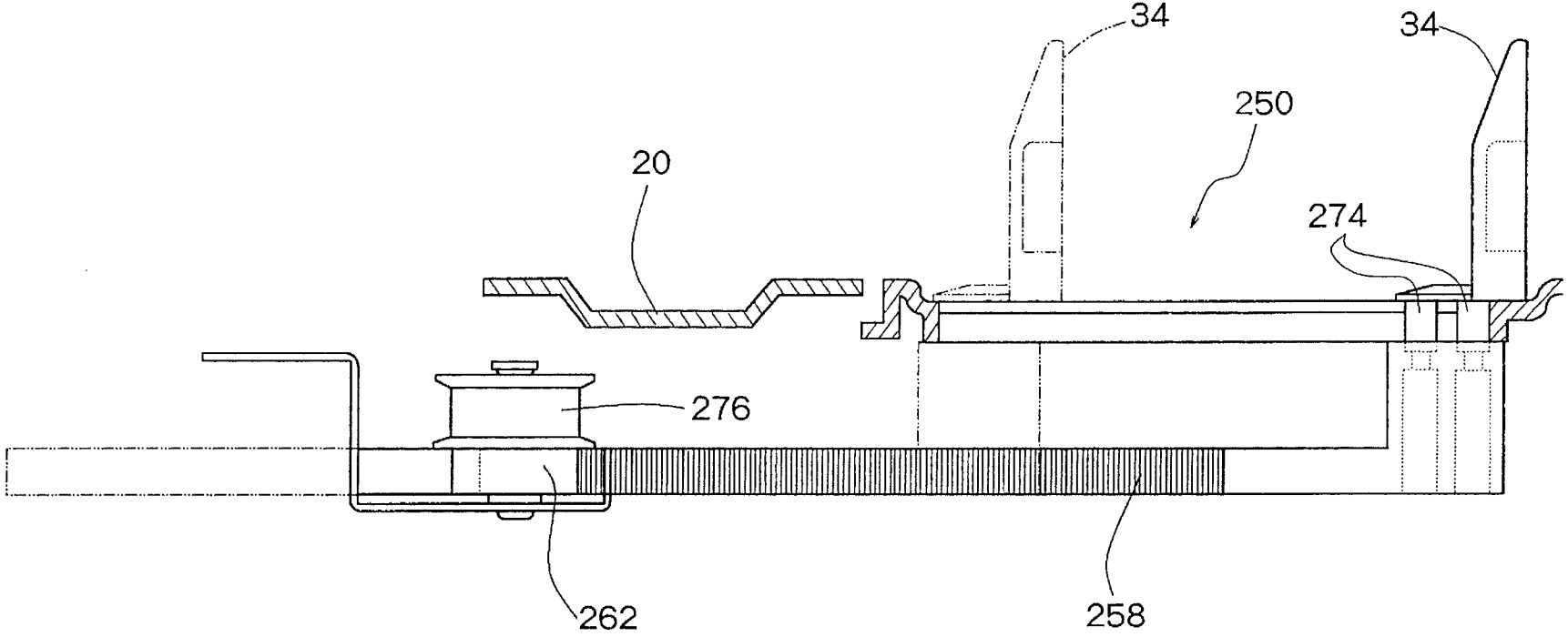
FIG. 24 is a sectional view which schematically illustrates the mechanism of FIG. 23, partly in a cut-away manner.

Mechanism for Moving Width Restriction Members:

With reference to FIGS. 1, 23 and 24, the stationary plate 20 is equipped with a pair of width restriction members 34 that are movable in the direction of width. Under the stationary plate 20 is provided a mechanism 250 that moves the width restriction members 34 in the directions to approach, or separate away from, each other. The mechanism 250 for moving the width restriction members includes a first rack-and-pinion mechanism 252 and a second rack-and-pinion mechanism 254 that are arranged maintaining a distance in the direction of conveying the document and that extend in the direction of width, and an interlocking means 256 that interlocks the first rack-and-pinion mechanism 252 and the second rack-and-pinion mechanism 254 in a synchronized manner. Each of the width restriction members 34 is respectively coupled to the first rack-and-pinion mechanism 252 and to the second rack-and-pinion mechanism 254. The first rack-and-pinion mechanism 252 is provided with a pair of racks 258 and 260 that are arranged maintaining a distance in the direction in which the document is conveyed and that extend in the direction of width, and a pinion 262 that is in mesh with the racks 258 and 260. The second rack-and-pinion mechanism 254 is provided with a pair of racks 264 and 266 that are arranged maintaining a distance in the direction in which the document is conveyed and that extend in the direction of width, and a pinion 268 that is in mesh with the racks 264 and 266. As the pinions 262 and 268 rotate, therefore, the pair of racks 258 and 260 and the other pair of racks 264 and 266 are caused to move in opposite directions relative to each other. The rack 258 moves along a channel-like guide rail 272 that is formed extending in the direction of width on a base 270 (which is partly shown in FIG. 23) that is disposed under the rack 258. Though not illustrated, other racks 260, 264 and 266 are so constituted as will be guided in the direction of width by a similar guide means.

One of the width restriction members 34 is coupled to, and is supported by, one end of each of the racks 258 and 266, and the other width restriction member 34 is coupled to, and is supported by, the other end of each of the racks 260 and 264. The racks are coupled to the width restriction members 34 by a plurality of coupling pins 274. The interlocking means 256 is constituted by toothed pulleys 276 and 278 that are fitted to the pinions 62 and 268 to rotate together therewith, and a toothed belt (endless belt) 280 that is wrapped around the toothed pulleys 276 and 278. Being constituted as described above, the width restriction members 34 are moved by hand in the directions to approach, or separate away from, each other. Even when the width restriction members 34 are long, they are permitted to stably move in parallel with each other. As shown in FIG. 1, the stationary plate 20 has four slits 20*d* (three slits are shown in the drawing) to permit the movement of the coupling pins 274 in the direction of width.

It is preferable that the above-mentioned document pushing-down/adjusting mechanism 90, document drawing/adjusting mechanism 150, document transfer mechanism 210 and mechanism 250 for moving the width restriction members be adapted to the document conveying apparatus 4 in relation to each other. It is, however, also possible to adapt them individually. Furthermore, the actions and effects brought about by the document pushing-down/adjusting mechanism 90, document drawing/adjusting mechanism 150, document transfer mechanism 210 and mechanism 250 for moving the width restriction members can be utilized not only in document conveying apparatuses of the circulation type in which the document delivered onto the stationary plate 20 is introduced again into the document conveying passage 56 via the document introduction passage 58 but also in document conveying apparatuses of the type in which the document delivered into the stationary plate 20 is not introduced again the document conveying passage 56 via the document introduction passage 58 and the stationary plate 20 is simply utilized as a document-receiving plate.

Figure 25:
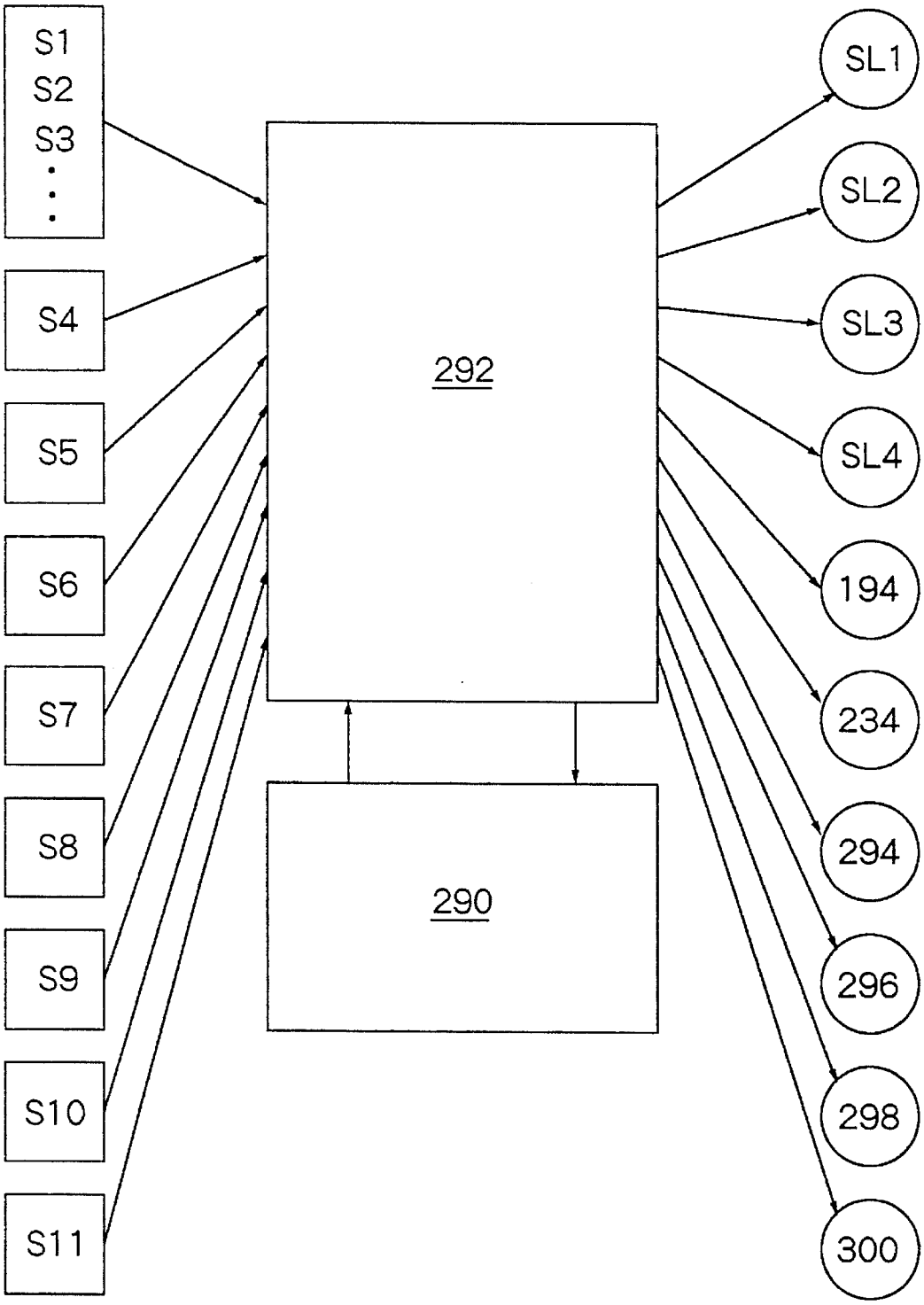
FIG. 25 is a diagram which illustrates in a simplified manner the constitution related to control operation disposed in the document conveying apparatus of FIG. 1.
Figure 26:
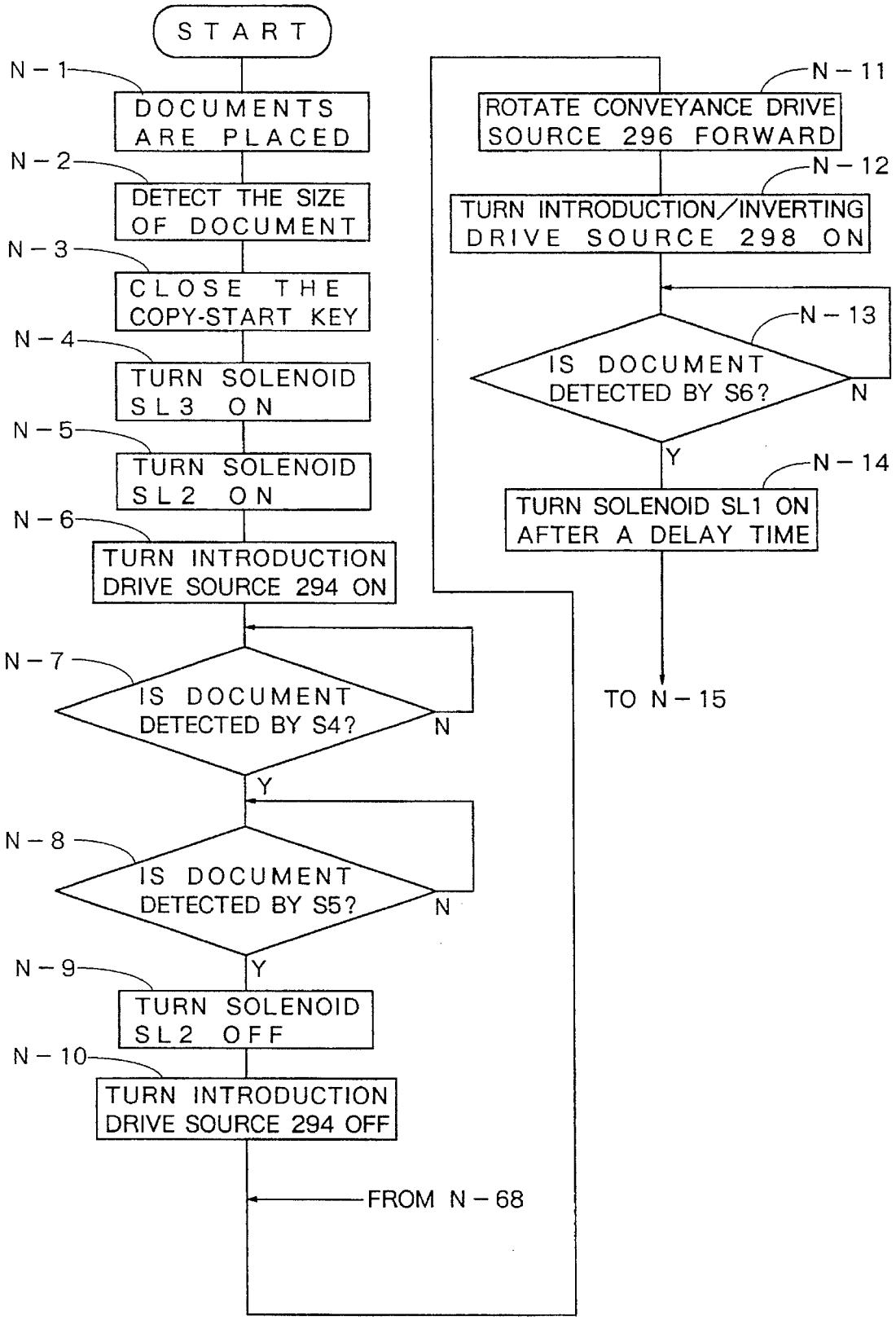
FIG. 26 is a flow chart illustrating part of the procedure for operating the document conveying apparatus of FIG. 1.
Figure 27:
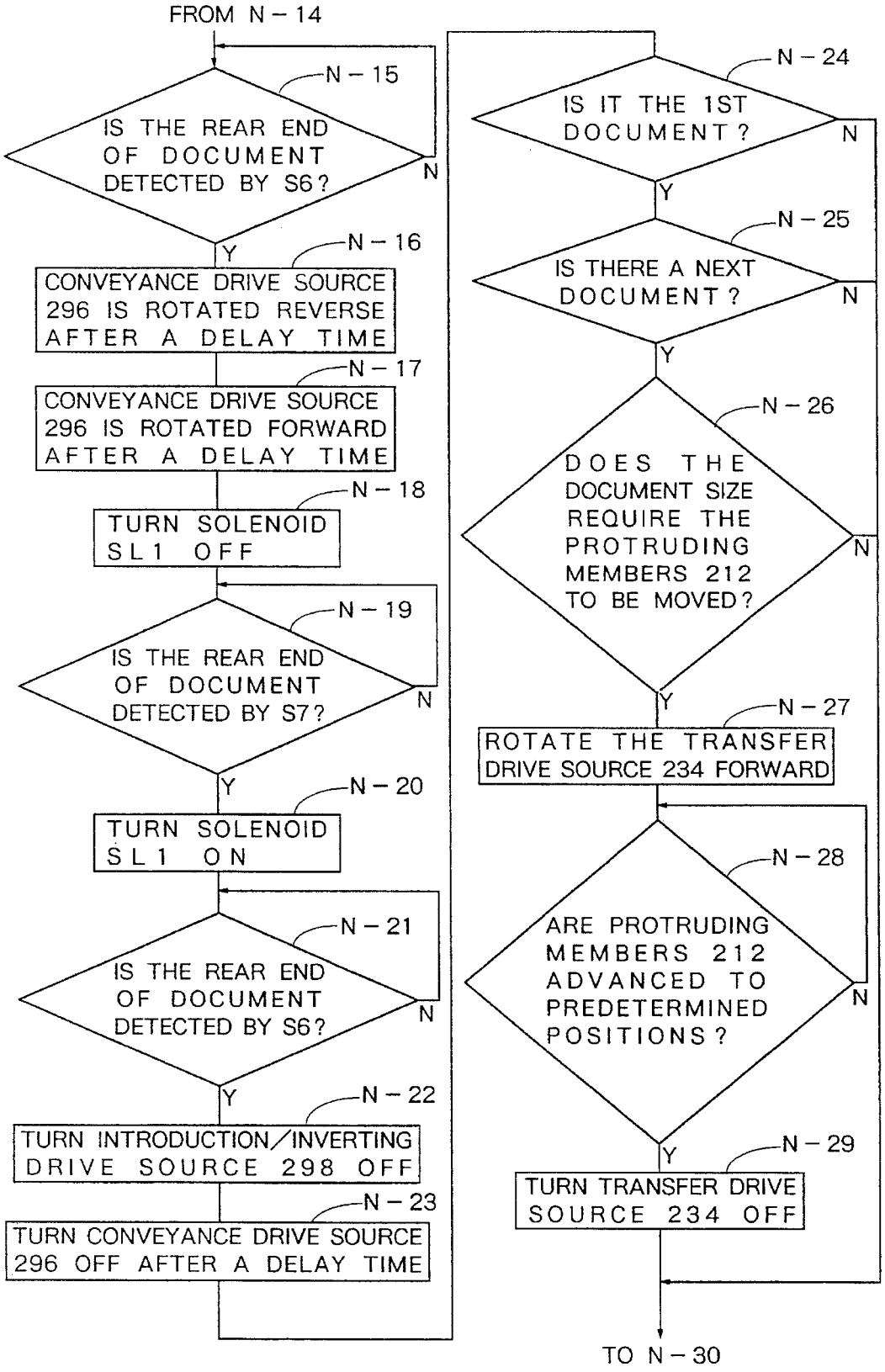
FIG. 27 is a flow chart illustrating part of the procedure for operating the document conveying apparatus of FIG. 1.
Figure 28:
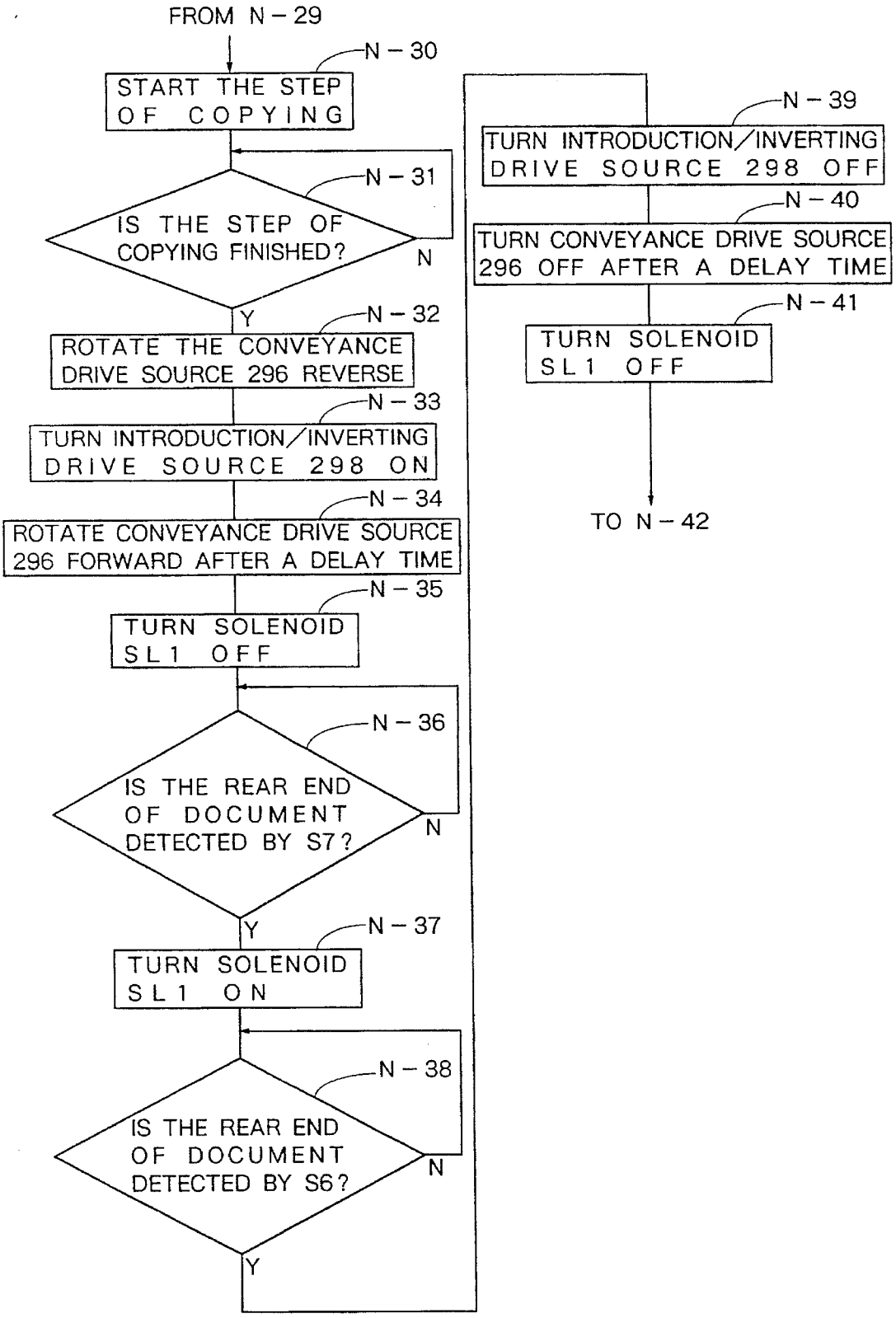
FIG. 28 is a flow chart illustrating part of the procedure for operating the document conveying apparatus of FIG. 1.
Figure 29:
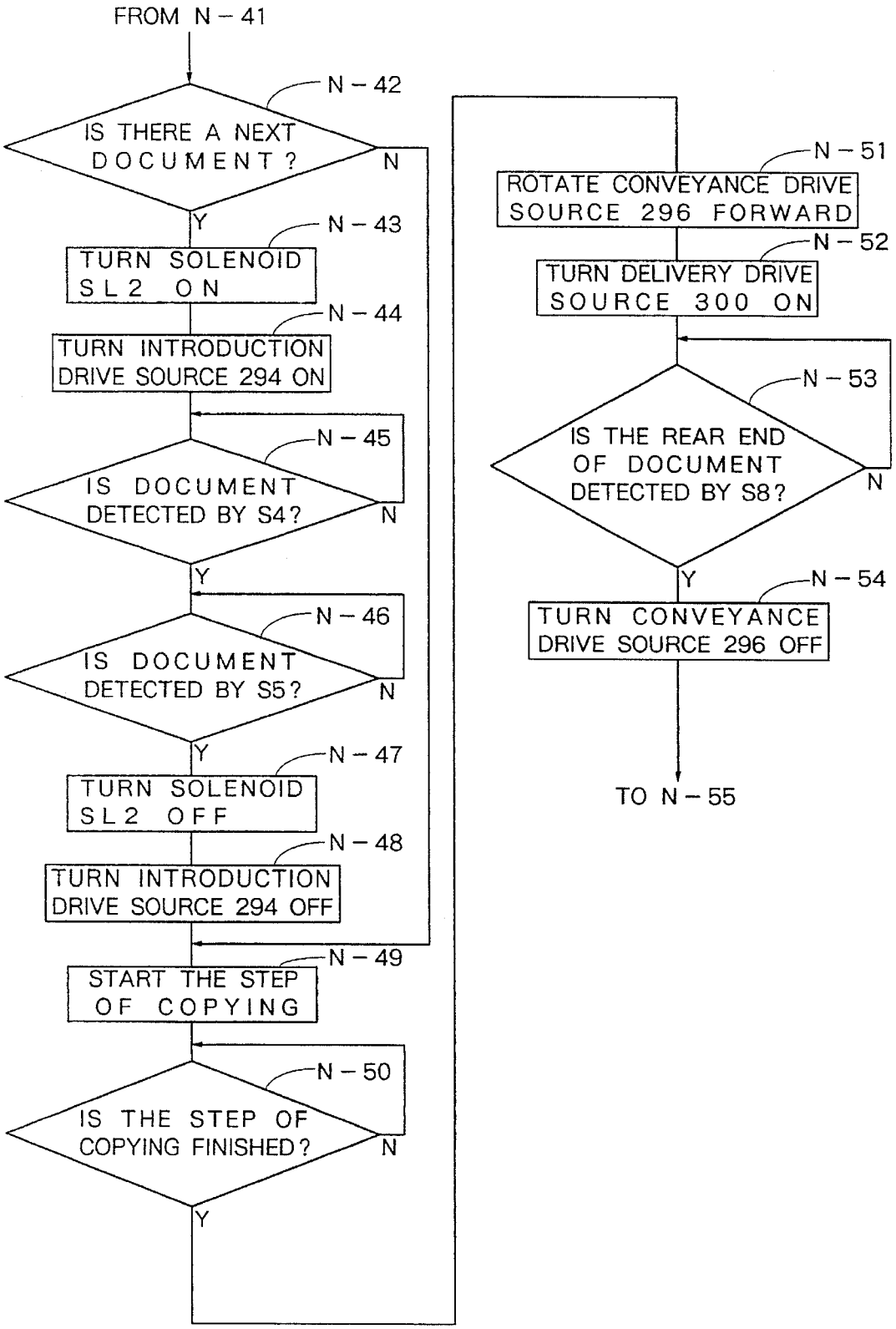
FIG. 29 is a flow chart illustrating part of the procedure for operating the document conveying apparatus of FIG. 1.
Figure 30:
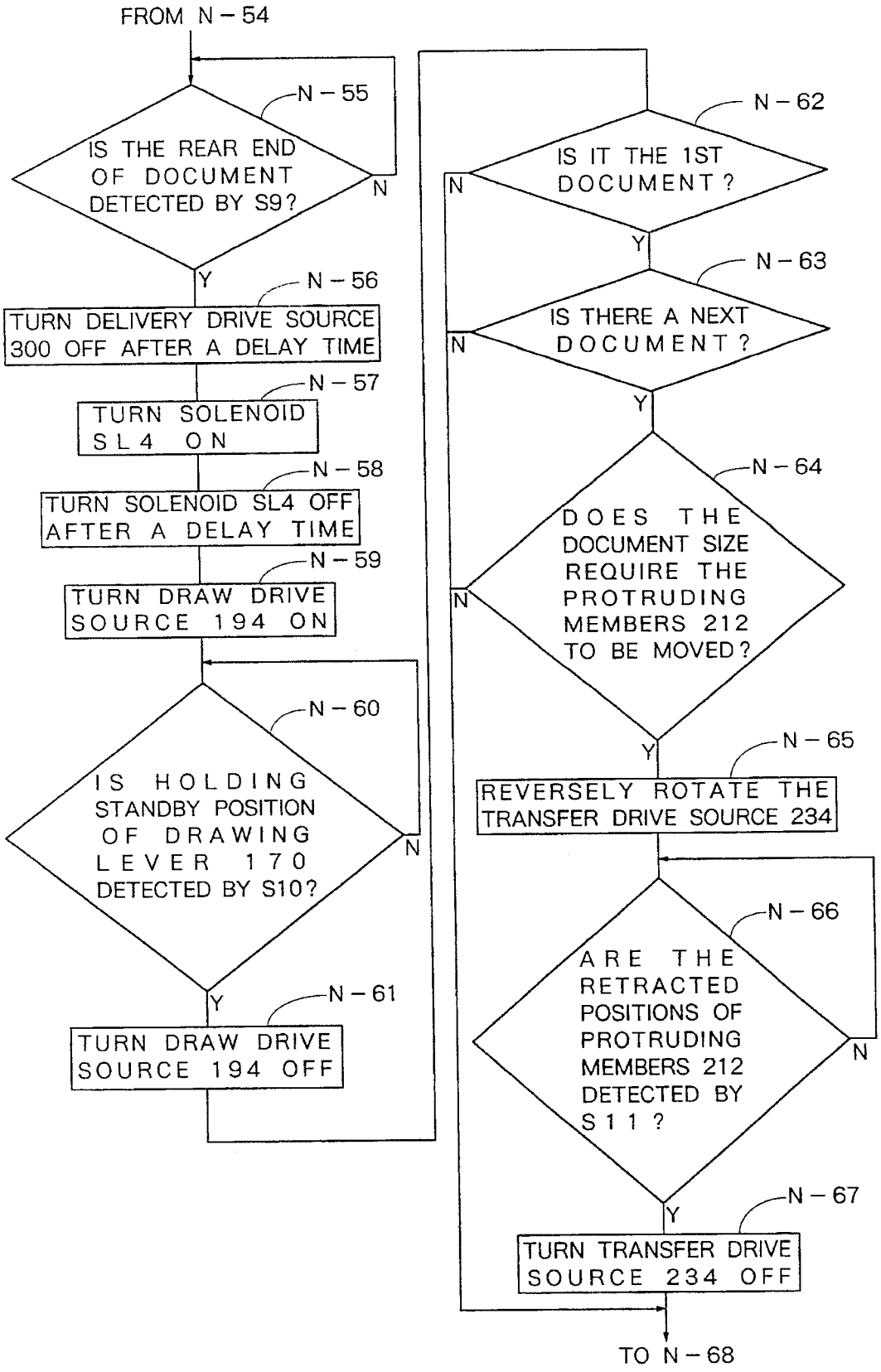
FIG. 30 is a flow chart illustrating part of the procedure for operating the document conveying apparatus of FIG. 1.
Figure 31:
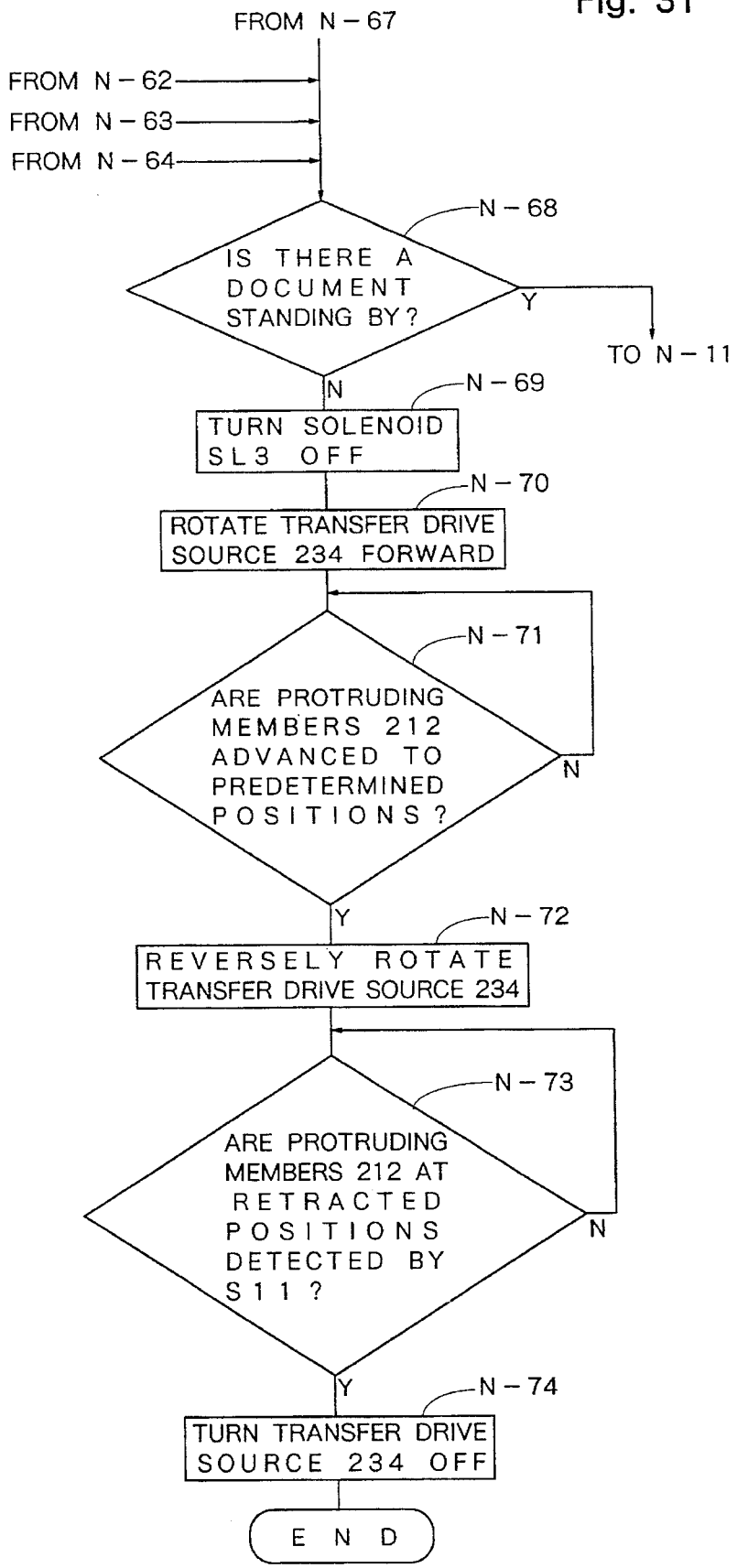
FIG. 31 is a flow chart illustrating part of the procedure for operating the document conveying apparatus of FIG. 1.

Procedure of Operation:

Procedure of operation of the above-mentioned document conveying apparatus 4 will now be described with reference to FIGS. 2, and 25, as well as the flow charts of FIGS. 26 to 31.

FIGS. 26 to 31 illustrate the procedure of operation when a plurality of documents placed, being stacked, on the stationary plate 20 are to be copied in a double-surface copying operation (such an operation is executed by manipulating a required key of the operation panel disposed on the upper surface of the housing 6 of the electrostatic copying machine 2, and a signal indicating the above condition is sent to a control means 292 in the document conveying apparatus 4 from a control means 290 in the electrostatic copying machine 2). At a step N-1, a plurality of documents are placed, being stacked, on the stationary plate 20, and are detected by a detector S1, which may be a reflection-type optical detector. At this moment, the front end of the stack of documents is brought in contact with the front-end-of-document restriction member 41 that is located at an ascended position indicated by a solid line in FIG. 2. Thus, the front end of the document is brought to the predetermined position. At a step N-2 the size of the document placed on the stationary plate 20 is detected. The size of the document is detected in a manner described below. That is, positions in the direction of width of the pair of width restriction members 34 that are moved by hand to a predetermined position in the direction of width, in accordance with the size of the document, are detected by a plurality of detector means (not shown), and the length of the document in the direction of conveyance is detected depending upon whether the document is detected by the document detectors S2 and S3 exposed on the surface of the stationary plate 20. Each of the detectors S2 and S3 may be a reflection-type optical detector.

A step N-3 closes a copy-start key that is arranged on the operation panel of the electrostatic copying machine 2. At a step N-4, the electromagnetic solenoid SL3 mounted in relation to the front-end-of-document restriction members 41 and the front-end-of-delivered-document restriction member 40 is energized, whereby the front-end-of-document restriction member 41 is brought to the descended position indicated by a two-dot chain line in FIG. 2 to permit the introduction of document and, at the same time, the front-end-of-delivered-document restriction member 40 is brought by its own weight to the descended position indicated by a two-dot chain line in FIG. 2, so that the lower end thereof is located at the uppermost position on the stack of the documents. Described below is the function of the front-end-of-delivered-document restriction member 40. As will be described later, when the copying step is started, the documents are successively fed starting from the one located at the lowermost position of the stack and are delivered onto the stationary plate 20 from the document discharge port 80. A maximum size of document that can be handled by the document conveying apparatus 4 of the aforementioned embodiment is A3 of the JIS Standards. Therefore, when documents having sizes (in the direction of conveyance) greater, for example, than B5R of the JIS Standards are to be copied, the front end of the discharged document is overlapped on the upper surface of the stack of documents being fed. There is a possibility, therefore, that when the document at the uppermost position is fed, the document that is overlapped thereon is caused to move in the downstream direction with the motion of the uppermost document, and is fed again. In the case of the document having the size A3, in particular, there exists only a small phase difference between the placed document and the delivered document in the direction of conveyance, and the delivered document is positioned on the placed document in a state in which it is mostly overlapped. This tendency becomes conspicuous particularly in the case of the A3-size documents, since they are readily drawn. This problem may take place even when the delivered document is held by the drawing levers 170 of the aforementioned document drawing/adjusting mechanism 150. The front-end-of-delivered-document restriction member 40 is provided to eliminate such a trouble.

At a step N-5, the electromagnetic solenoid SL2 provided for the pushing member 38 is energized, whereby the pushing member 38 is lowered to push the document placed on the stationary plate 20 onto the feeding rollers 36 (see a two-dot chain line in FIG. 2). At a step N-6, an introduction drive source 294 (FIG. 25), which may be an electric motor, is energized, and the document separation means 42 is operated together with the feed rollers 36. The document at the lowermost position of the stack of document placed on the stationary plate 20 starts being delivered onto the document introduction passage 58. A step N-7 discriminates whether the detector S4 has detected the document on the upstream side of the pair of introduction rollers 66. The detector S4 can be constituted by a reflection-type optical detector. When the detector S4 detects the document, the program proceeds to a step N-8, and the front end of the document that is introduced is brought into contact with the nip portions of the pair of introduction rollers 66 that are in the non-acting state. Then, as the front portion of the document bends, the detector S5, that detects the document, detects the bend of the document and discriminates whether the front end of the document is brought into sufficient contact with the nip portions of the pair of introduction rollers 66 and whether the paper can be secondarily fed or not. The detector S5 can be constituted by a transmission-type optical detector. When the detector S5 detects the bend of the document, the program proceeds to a step N-9 whereby the electromagnetic solenoid SL2 is de-energized and the pushing member 38 is returned back to the ascended position indicated by a solid line in FIG. 2. Then, at a step N-10, the introduction drive source 294 is de-energized, and the feed rollers 36 and the document separation means 42 are returned to the non-acting state.

At a step N-11, a conveyance drive source 296 (FIG. 25), which may be an electric motor, is rotated forward, and the conveyer belt mechanism 48 starts rotating in the counter-clockwise direction in FIG. 2. At a step N-12, an introduction/inversion drive source 298 (FIG. 25) which may be an electric motor is energized, whereby the pair of introduction rollers 66 are rotated and the inversion roller 62 is rotated, too. Thus, the document that is introduced up to the pair of introduction rollers 66 is further advanced and is introduced into the document conveying passage 56. A step N-13 discriminates whether a detector S6 has detected the document or not on the downstream side of the pair of introduction rollers 66. After the passage of a time required from when the document is detected by the detector S6, which may be a reflection-type optical detector, until when the front end of the document arrives at the transparent plate 8, the program proceeds to a step N-14, whereby the electromagnetic solenoid SL1 mounted on the document restriction member 10 is energized, and the document restriction member 10 is lowered to the descended position indicated by a two-dot chain line in FIG. 2. The lowering of the document restriction member 10 is effected in order to decrease the conveyance resistance against the document that is being conveyed and to minimize undesired conveyance resistance. Then, a step N-15 discriminates whether the rear end of the document has passed over the detector S6 and whether the detector S6 no longer detects the document. When the detector S6 no longer detects the document, the program proceeds to a step N-16 by which the conveyance drive source 296 is changed over to the inversion drive after a predetermined period of time (required for the rear end of the document passing over the document restriction member 10) has passed, and the conveyer belt mechanism 48 starts rotating in the clockwise direction in FIG. 2. Thus, the document that is once introduced into the document conveying passage 56 is returned back from the document conveying passage 56 and is introduced into the document inverting passage 60.

At a step N-17, the conveyance drive source 296 is changed over again to the forward drive after the passage of a time up to when the front end of the document introduced into the document inverting passage 60 is nipped by the pair of inverting rollers (inverting roller 60 and roller 62*a*). At a step N-18, the electromagnetic solenoid SL1 is de-energized and the document restriction member 10 is returned to the ascended position (acting position). A step N-19 discriminates whether a detector S7 has detected the rear end of the document that is being transferred through the document inverting passage 60, i.e., discriminates whether the document that was once detected is no longer detected. The detector S7 can be constituted by using a micro-switch. When the detector S7 detects the rear end of the document, the program proceeds to a step N-20 where the electromagnetic solenoid SL1 is energized and the document restriction member 10 is lowered again to the descended position. The program then proceeds to a step N-21 which discriminates whether the detector S6 has detected the rear end of the document that has passed through the document inverting passage 60 and is inverted front surface back, i.e., discriminates whether the document that was once detected is no longer detected. As the detector S6 detects the rear end of the document, the program proceeds to a step N-22 where the introduction/inversion drive source 298 is de-energized, the pair of introduction rollers 66 are placed in the inoperating condition and the inverting roller 62 is placed in the inoperating condition. A step N-23 de-energizes the conveyance drive source 296 after the passage of a predetermined period of time (required for the rear end of the document passing over the document restriction member 10) and places the conveyer belt mechanism 48 in the non-acting condition. Then, the document which has been inverted front surface back is placed at a predetermined position (where its one edge is positioned in contact with, or close to, the tip of the document restriction member 10) on the transparent plate 8 of the electrostatic copying machine 2.

A step N-24 discriminates whether the document introduced onto the document conveying passage 56 is the first one or not. When the document that has been delivered is not the first one, the program proceeds to a step N-30. When the document that has been delivered is the first one, the program proceeds to a step N-25 where it is discriminated whether there are documents that are to be successively introduced onto the stationary plate 20. When there is no document that is to be successively introduced, the program proceeds to a step N-30. When there are documents that are to be successively introduced, the program proceeds to a step N-26 where it is discriminated whether the document has a size that requires the protruding members 212 to be moved. When the document has a size that does not require the protruding members 212 to be moved (in this embodiment, for instance, a document of JIS Standards B5 that is transversely placed, a document of A4 that is transversely placed and a document of A3), the program proceeds to a step N-30. When the document has a size that requires the protruding members 212 to be moved (in this embodiment, documents of JIS Standards B5R, A4R and B4), the program proceeds to a step N-27. Here, the words "transversely placed" stand for that ordinary placement of the document is turned by 90 degrees with respect to the ordinary arrangement such that the lengthwise direction of the document is in the direction of width on the stationary plate 20. At a step N-27, the transfer drive source 234 of the document transfer mechanism 210 is driven forward. As a result, the protruding members 212 located at the retracted positions at the back at the upstream end of the stationary plate 20 are advanced. A step N-28 discriminates whether the protruding members 212 have been advanced by the document transfer mechanism 210 to a predetermined advanced position that meets the size of the document. When the protruding members 212 have been advanced to the predetermined advanced position, the program proceeds to a step N-29 where the transfer drive source 234 is deenergized and is no longer driven forward.

At a step N-30, a copying step start signal is transmitted to the control means 290 of the electrostatic copying machine 2, and then the step of copying starts. A step N-31 discriminates whether the step of copying has finished or not in the electrostatic copying machine 2 (whether the control means 290 of the electrostatic copying machine 2 has produced a document exchange signal or not). When the step of copying has finished in the electrostatic copying machine 2, the program proceeds to a step N-32 where the conveyance drive source 296 is reversely rotated and the conveyer belt mechanism 48 is rotated in the clockwise direction in FIG. 2. At a step N-33, an introduction/inverting drive source 298 is energized to rotate the pair of introduction rollers 66 and an inverting roller 62. Thus, the document on the transparent plate 8 is conveyed from the document conveying passage 56 to the document inverting passage 60.

At a step N-34, the conveyance drive source 296 is changed over to the forward drive after the passage of sufficient time for the front end of the document introduced into the document inverting passage 60 to return. At a step N-35, the electromagnetic solenoid SL1 is de-energized, and the document restriction member 10 is returned back to the ascended position. A step N-36 discriminates whether a detector S7 has detected the rear end of the document that moves in the document inverting passage 60. When the detector S7 detects the rear end of the document, the program proceeds to a step N-37 where the electromagnetic solenoid SL1 is energized and the document restriction member 10 is lowered again to the descended position. The program then proceeds to a step N-38 where it is discriminated whether the detector S6 has detected the rear end of the document that has been reinverted front surface back after having passed through the document inverting passage 60. When the detector S6 detects the rear end of the document, the program proceeds to a step N-39 where the introduction/inverting drive source 298 is de-energized, and the pair of introduction rollers 66 and the inverting roller 62 are placed in the non-acting condition. At a step N-40, the conveyance drive source 296 is de-energized after the passage of a predetermined period of time (required for the rear end of the document to pass over the document restriction member 10), and the conveyer belt mechanism 48 is placed in the non-acting condition. Thus, the document which has been inverted front surface back is placed at a predetermined position on the transparent plate 8 of the electrostatic copying machine 2. At a step N-41, the electromagnetic solenoid SL1 is de-energized and the document restriction member 10 is returned back to the ascended position.

A step N-42 discriminates whether there are documents that are to be successively introduced onto the stationary plate 20. When there is no document that is to be introduced next, the program proceeds to a step N-49. When there are documents that are to be successively introduced, the program proceeds to a step N-43 where the electromagnetic solenoid SL2 is energized and the pushing member 38 is lowered to push the document on the stationary plate 20 onto the feed roller 36. At a step N-44, the introduction drive source 294 is energized, and the document separation means 42 operates together with the feed roller 36. As a result, the next document, i.e., the document at the lowermost position of the stack of documents on the stationary plate 20, begins to be introduced into the document introduction passage 58. Then, a step N-45 discriminates whether the detector S4 has detected the document or not. When the detector S4 detects the document, the program proceeds to a step N-46 where it is discriminated whether the detector S5 has detected the document or not. When the detector S5 detects the document, the program proceeds to a step N-47 where the electromagnetic solenoid SL2 is de-energized, and the pushing member 38 is returned back to the ascended position indicated by the solid line in FIG. 2. Then, at a step N-48, the introduction drive source 294 is de-energized, and the feed rollers 36 and the document separation means 42 are returned back to the non-acting condition. The program then proceeds to a step N-49.

At a step N-49, a copying step start signal is transmitted to the control means 290 of the electrostatic copying machine 2, and the electrostatic copying machine 2 begins the step of copying. A step N-50 discriminates whether the step of copying has finished or not in the electrostatic copying machine 2. As the step of copying has finished in the electrostatic copying machine 2, the program proceeds to a step N-51 where the conveyance drive source 296 is rotated forward and the conveyer belt mechanism 48 is rotated in the counterclockwise direction in FIG. 2. At a step N-52, a delivery drive source 300 (FIG. 25), which may be an electric motor, is energized, and the pair of delivery rollers 82, the pair of delivery rollers 84 and the pair of document discharge roller 86 are rotated simultaneously. Thus, the document on the transparent plate 8 is conveyed from the document conveying passage 56 to the document delivery passage 74 and begins to be delivered onto the stationary plate 20 via the document delivery passage 74 and the document discharge port 80. A step N-53 discriminates whether the rear end of the document has been detected by a detector S8 at the upstream end portion of the document delivery passage 74. The detector S8 can be constituted by a micro-switch. When the detector S8 detects the rear end of the document, the program proceeds to a step N-54 where the conveyance drive source 296 is de-energized and the conveyer belt mechanism 48 is no longer driven. Then, a step N-55 discriminates whether the rear end of the document has been detected by a detector S9 at the downstream end portion of the document delivery passage 74 which is at the upstream position of the pair of document delivery rollers 86, i.e., discriminates whether the document that was once detected is still detected or not. When the detector S9, that may be a reflection-type optical detector, detects the rear end of the document, the program proceeds to a step N-56 where the delivery drive source 300 is de-energized after the passage of a predetermined period of time (time required up to when the rear end of the document pass over the nip portions of the pair of document discharge rollers 86 or, in other words, time required up to when the rear end of the document is substantially liberated from being nipped by the pair of document discharge rollers 86). As a result, the pair of delivery rollers 82, pair of delivery rollers 84 and pair of document discharge rollers 86 are brought to a halt simultaneously.

At a step N-57, the electromagnetic solenoid SL4 of the document pushing-down/adjusting mechanism 90 is energized. The lever member 92 is then turned up to the acting position. The tip of the lever member 92 acts upon the rear end of the document on delivery after its rear end has been substantially liberated from being nipped by the pair of document discharge rollers 86, and forcibly pushes the rear end of the document to the upper surface at the upstream end position of the stationary plate 20. The tip of the lever member 92 is substantially restricted from turning by the upper surface of the stationary plate 20 (by the upper surface of the document at the uppermost position when discharged document(s) already exist on the stationary plate 20). At a step N-58, the electromagnetic solenoid SL4 is de-energized after the passage of a predetermined period of time (after the time in which the tip of the lever member 92 starts downwardly turning and arrives at the upper surface of the stationary plate 20 and in which the acting position is maintained in order to prevent the delivered document positioned between it and the upper surface of the stationary plate 20 from moving toward the downstream direction). As a result, the tip of the lever member 92 upwardly turns from the upper surface of the stationary plate 20 and is brought to the nonacting position. The discharged document is brought to a predetermined delivered position on the stationary plate 20 under a condition in which its rear end is adjusted. After the electromagnetic solenoid SL4 is de-energized, the program proceeds to a step N-59. In the case where two lever members 130 and 132 are used instead of the lever member 92, it will be easily understood that the substantially same actions as that of the above-mentioned lever member 92 are simultaneously performed.

At a step N-59 a draw drive source 194 of the document drawing/arranging mechanism 150 is rotated to be driven. The drawing lever 170 that moves together with the moving body means 154 once moves from the standby position to the upstream end position, and then moves from the upstream end position to the downstream end position which is higher than the upstream end position, and then descends. The downstream end of the drawing lever 170 is located at the draw start position where it is descended to the rear end of the delivered document that is forcibly positioned by the document pushing-down/adjusting mechanism 90. The rear end of the delivered document is pushed onto the stationary plate 20 by the lower surface at the downstream end of the drawing lever 170. The drawing lever 170 then moves toward the holding standby position in the upstream direction. During this movement, the rear end of the delivered document is moved in the upstream direction of the stationary plate 20 by the lower surface of the downstream end of the drawing lever 170. The program then proceeds to a step N-60 where it is discriminated whether the holding standby position of the moving body means 154 or the drawing lever 170 has been detected by a detector S10 which is constituted by a transmission-type optical detector that detects the rotational position of one of the rotary disks 192. When the holding standby position of the drawing lever 170 is detected, the program proceeds to a step N-61 where the draw drive source 194 is de-energized and ceases to rotate. The drawing lever 170 is stopped at the holding standby position. The rear end of the delivered document is brought into contact with the end wall 20c of the stationary plate 20, so that its position is adjusted.

A step N-62 discriminates whether the document delivered onto the stationary plate 20 is the first one or not. When the document that is delivered is not the first one, the program proceeds to a step N-68. When the document that is delivered is the first one, the program proceeds to a step N-63 where it is discriminated whether there are documents that are to be successively introduced onto the stationary plate 20. When there is no document that is to be introduced next, the program proceeds to a step N-68. When there are documents that are to be successively introduced, the program proceeds to a step N-64 where it is discriminated whether the document has a size that requires the protruding members 212 to be moved. When the document has a size that does not require the protruding members 212 to be moved, the program proceeds to the step N-68. When the document has a size that requires the protruding members 212 to be moved, the program proceeds to a step N-65. At the step N-65, the transfer drive source 234 of the document transfer mechanism 210 is reversely driven. As a result, the protruding members 212 located at the advanced positions are retracted toward the upstream of the stationary plate 20. A step N-66 discriminates whether the detector S11 has detected the protruding members 212 that are located at the retracted positions indicated by solid lines in FIG. 2. When the detector S11, that may be a transmission-type optical detector, detects the protruding members 212 located at the retracted positions, the program proceeds to a step N-67 where the transfer drive mechanism 234 is de-energized and the protruding members 212 are stopped at the retracted positions.

A step N-68 discriminates whether there is a document that is standing by in the document introduction passage 58. When the document is standing by in the document introduction passage 58, the program returns back to the step N-11. When there is no document that is standing by in the document introduction passage 58, the program proceeds to a step N-69 where the electromagnetic solenoid SL3 is de-energized. As a result, the front-end-of-document restriction member 41 is pivoted to the ascended position indicated by the solid line in FIG. 2, whereby the document is restricted from being introduced and the front-end-of-delivered-document restriction member 40, too, is pivoted to the ascended position indicated by the solid line in FIG. 2, and the lower ends thereof are positioned maintaining a distance over the stationary plate 20. At a step N-70, the transfer drive source 234 of the document transfer mechanism 210 is driven forward. Therefore, the protruding members 212 located at the back of the document delivered onto the stationary plate 20 are advanced, and consequently the document delivered onto the stationary plate 20 is advanced. A step N-71 discriminates whether the document has been advanced to the predetermined advanced position by the document transfer mechanism 10. When the document has been advanced to the predetermined advanced position, the program proceeds to a step N-72 where the transfer drive source 234 of the document transfer mechanism 210 is driven in the reverse direction. As a result, the protruding members 212 located at the advanced positions are retracted toward the upstream of the stationary plate 20. A step N-73 discriminates whether the protruding members 212 brought to the retracted positions indicated by the solid lines in FIG. 2 have been detected by the detector S11. When the detector S11 detects the protruding members 212 that are brought to the retracted position, the program proceeds to a step N-74 where the transfer drive source 234 is de-energized and the protruding members 212 are stopped at the retracted position.

Owing to relatively compact and inexpensive constitution, the document conveying apparatus of the present invention liberates the user from the need of executing cumbersome operation, and makes it possible to reliably specify the positions for delivering the documents having a variety of sizes. The apparatus as a whole is relatively light in weight. The pair of width restriction members provided for the document-placing plate means can be stably moved in parallel with each other even when these width restriction members are long. Moreover, the documents delivered onto the document-placing plate means from the document discharge passage can be placed at the uppermost position of the stack of document without permitting it to be mixed into the stack of documents. When the document must be introduced again into the document conveying passage through the document introduction passage, the document delivered onto the document-placing plate means can be reliably advanced to a required position for introducing it onto the document-placing plate means.

Though the invention was described above in detail by way of an embodiment, it should be noted that the invention is in no way limited to the above-mentioned embodiment only but can be varied or modified in a variety of other ways without departing from the scope of the invention.

What we claim is:

1. A document conveying apparatus for a document processor having a transparent plate for placement thereon of a document to be processed, said document conveying apparatus comprising:

document-placing plate means adapted to be positioned above the transparent plate of the document processor, means defining a document conveying passage extending along a surface of the transparent plate, means defining a document introduction passage disposed between the document-placing plate means and the document conveying passage, means defining a document delivery passage disposed between the document conveying passage and the document-placing plate means and having a document discharge port, document introduction means for successively introducing a plurality of pieces of documents from a stack of documents on said document-placing plate means into said document conveying passage through said document introduction passage, starting with a document at the lowermost position of the stack, document conveying means for conveying the documents through said document conveying passage, document delivery means for delivering the document conveyed from said document conveying passage onto said document placing plate means through said document delivery passage, said document delivery means including a pair of document discharge rollers disposed near said document discharge port of said document delivery passage, a document pushing-down/adjusting mechanism disposed at an upper position on the downstream side of said document discharge port, for acting on the rear end of a document being delivered by said document delivery means after the rear end of the document is substantially liberated from the pair of document discharge rollers, forcibly pushing down the rear end of the document toward the upstream end of said document-placing plate means, and holding the document on said document-placing plate means for a first predetermined period of time.

2. A document conveying apparatus according to claim 1, further comprising a document drawing/adjusting mechanism for pushing down against the rear end of the document positioned on said document-placing plate means, drawing the document in the upstream direction, and holding the document for a second predetermined period of time.

3. A document conveying apparatus according to claim 1, further comprising a document transfer mechanism, including protrusion means for reciprocatingly moving between a retracted position on the upstream side of said document-placing plate means and an advanced position a predetermined distance downstream from the retracted position, said protrusion means upwardly protruding beyond the surface of said document-placing means.

4. A document conveying apparatus according to claim 1 further comprising a cover having an upper wall portion on one side of said document conveying apparatus and located at an upper position on the downstream side of said document discharge port extending in the direction of width of said document conveying apparatus; and wherein:

said document pushing-down/adjusting mechanism includes pushing-down lever means extending in the direction of width along said upper wall portion, an electromagnetic solenoid on said upper wall portion and coupled to one end of said pushing-down lever means, and spring means between said upper wall portion and said pushing-down lever means;

said pushing-down lever means is pivotably supported, with said one end thereof as a fulcrum, on said upper wall portion so as to move between a non-acting position in which the other end thereof is located at a high position, so as not to interfere with the document delivered from said document discharge port, and an acting position in which said other end thereof is located on the upper surface of said document-placing plate means, and said spring means urges said pushing-down lever means to the non-acting position at all times, and said electromagnetic solenoid, when energized, turns said pushing-down lever means to the acting position against the urging force of said spring means.

5. A document conveying apparatus according to claim 4, wherein said electromagnetic solenoid holds said pushing-down lever means in the acting position for the first predetermined period of time after said pushing-down lever means is turned to the acting position.

6. A document conveying apparatus according to claim 4, wherein said other end of said pushing-down lever means includes a rubber piece.

7. A document conveying apparatus according to claim 4, wherein said pushing-down lever means comprises two lever members separated by a distance in the direction in which the delivered document moves, and extending in parallel in the direction of width of said document conveying apparatus, each lever member supported by said upper wall portion and having an end on one side serving as a fulcrum to turn said lever members in the opposite directions relative to each other, said lever members being coupled at said ends on said one side to said electromagnetic solenoid so as to move substantially simultaneously between the non-acting position and the acting position.

8. A document conveying apparatus according to claim 7, wherein:

said two lever members comprise a first lever having said end on said one side positioned on the side of said first lever nearer said electromagnetic solenoid; a second lever having said end on said one side positioned on the side of said second lever opposite said electromagnetic solenoid; a first coupling pin outwardly protruding from a lower portion of said end on said one side of said first lever; a pair of first support pins at upper portions of both ends of said first coupling pin, said first support pins outwardly protruding from said both ends and arranged coaxially; a second coupling pin outwardly protruding from an upper portion of said end on said one side of said second lever in a direction opposite to said first coupling pin; and a pair of second support pins at lower portions of both ends of said second coupling pin, said second support pins outwardly protruding and arranged coaxially;

said pushing down lever means further comprises a coupling lever extending along said upper wall portion and having one end coupled to said electromagnetic solenoid; and said first and second support pins are pivotably supported by said upper wall surface, with said first coupling pin pivotably coupled to an intermediate portion of said coupling lever, and said second coupling pin pivotably coupled to a second end of said coupling lever, said coupling lever extending from said one end to said intermediate portion and through a gap between said first lever member and said second lever member to said second end.

9. A document conveying apparatus for a document processor having a transparent plate for placement thereon of a document to be processed, said document conveying apparatus comprising:

document-placing plate means adapted to be positioned above the transparent plate of the document processor, means defining a document conveying passage extending along a surface of the transparent plate, means defining a document introduction passage disposed between the document-placing plate means and the document conveying passage, means defining a document delivery passage disposed between the document conveying passage and the document-placing plate means and having a document discharge port, document introduction means for successively introducing a plurality of pieces of documents from a stack of documents on said document-placing plate means into said document conveying passage through said document introduction passage, starting with a document at the lowermost position of the stack, document conveying means for conveying the documents through said document conveying passage, document delivery means for delivering the document conveyed from said document conveying passage onto said document-placing plate means through said document delivery passage, said document delivery means including a pair of document discharge rollers disposed near said document discharge port of said document delivery passage, a document drawing/adjusting mechanism for pushing downward against the rear end of the document that has been delivered onto said document-placing plate means through said document delivery passage to draw the document toward the upstream direction of said document conveying apparatus and holding the document for a predetermined period of time.

10. A document conveying apparatus according to claim 9, further comprising a document transfer mechanism, including protrusion means for reciprocatingly moving between a retracted position on the upstream side of said document-placing plate means and an advanced position a predetermined distance downstream from said retracted position, said protrusion means upwardly protruding beyond the surface of said document-placing plate means.

11. A document conveying apparatus according to claim 9, wherein:

said document drawing/adjusting mechanism includes support plate means further upstream on said document conveying apparatus than said document-placing plate means, moving body means supported on said support plate means for reciprocatingly moving in a direction in which the delivered document moves, and drive means for reciprocatingly moving said moving body means;

said moving body means includes drawing lever means, extending in the direction in which the delivered document moves, and first spring means;

said support plate means includes guide plane means extending parallel to an outer side of said drawing lever means and having a downstream-side guide plane parallel to the upper surface of said document-placing plate means, an upstream-side guide plane formed continuously to said downstream-side guide plane, and a tilted guide plane rising in the downstream direction from the downstream end of said upstream-side guide plane, said tilted guide plane being defined by the upper surface of a tilted lever member pivotably supported at the downstream end portion thereof over said downstream-side guide plane while maintaining a distance relative thereto, and second spring means urging the upstream end portion of said tilted lever member into contact with said upstream-side guide plane;

the upstream end of said drawing lever means is pivotably supported by said moving body means, and said first spring means urges the downstream end portion of said drawing lever means to turn downwardly, said drawing lever means including guide pin means that protrudes toward the outer side thereof, and said guide pin means is pushed onto said guide plane means by the urging force of said first spring means and is so positioned as to move along therewith;

when said moving body means is brought to a standby position between a downstream end position and an upstream end position thereof within the range of reciprocating movement thereof, said guide pin means of said drawing lever means is brought to a guide standby position on the upstream side from the downstream end of said downstream-side guide plane;

when said moving body means is moved to said upstream end position from said standby position, an upstream end portion of said tilted lever member is pushed up by the movement of said guide pin means against the urging force of said second spring means, whereby said guide pin means is permitted to move to said upstream-side guide plane from said downstream-side guide plane;

the position of the downstream end of said tilted guide plane and the position of the downstream end of said downstream-side guide plane are so defined that said guide pin means after moving along the tilted guide plane from the upstream-side guide plane to the upper side in the downstream direction, is lowered from the downstream end of the tilted guide plane to the downstream end of the downstream-side guide plane and is positioned, when said moving body means is moved to said downstream end position from said upstream end position;

when said moving body means is moved from said downstream end position to said standby position, said guide pin means is moved from the downstream end of said downstream-side guide plane to said guide standby position and is positioned;

when said moving body means is moved to said downstream end position, the lower surface of the downstream end portion of said drawing lever means descends down to a draw start position that is downstream from the upstream end of said document-placing plate means and is pushed onto the upper surface of said document-placing plate means; and when said moving body means is brought to said standby position, said downstream end portion of said drawing lever means is brought to the holding standby position which is slightly downstream from the upstream end of said document-placing plate means, but upstream from the draw start position.

12. A document conveying apparatus according to claim 11, wherein the upstream end of said document-placing plate means is defined by an end wall extending upwardly from the upper surface of said document-placing plate means, said end wall being disposed at an upper position neighboring said downstream end portion of said drawing lever means holding standby position, and does not interfere with the reciprocating movement of said moving body means including said drawing lever means.

13. A document conveying apparatus according to claim 11, wherein at said holding standby position of said drawing lever means, the upper surface of said document-placing plate means, on which the downstream end portion of said drawing lever means is positioned, is lower than said upper surface at said draw start position.

14. A document conveying apparatus according to claim 11, wherein the lower surface of the downstream end portion of said drawing lever means is defined by a rubber piece.

15. A document conveying apparatus according to claim 11, wherein said upstream-side guide plane is higher than said downstream-side guide plane, and said guide plane means further includes a second tilted guide plane connecting said upstream-side guide plane and said downstream-side guide plane.

16. A document conveying apparatus according to claim 11, wherein:

said support plate means comprises a pair of support plates disposed a distance apart in the direction of width of said document conveying apparatus, and having substantially the same constitution, said guide plane means are provided for each of said support plates and have substantially the same constitution, said support plates are provided at their opposing inner positions with guided rail means having substantially the same constitution and extending in the direction in which the delivered document moves, said moving body means includes, on both outer sides in the direction of width thereof, guide rail means movably fitted to said guided rail means, and said drawing lever means comprises drawing levers pivotably supported at both outer sides of said moving body means in the direction of width of said document conveying apparatus and having substantially the same constitution.

17. A document conveying apparatus according to claim 11, wherein:

said moving body means includes guide groove means linearly extending in the direction of width of said document conveying apparatus and having at least the lower portion thereof opened, said drive means includes a rotary disk disposed under said guide groove means and a drive source for rotating said rotary disk, said rotary disk includes an upwardly protruding pin member, and said pin member is engaged to move along, and relative to, said guide groove means, converting the rotation of said rotary disk into the reciprocating movement of said moving body means.

18. A document conveying apparatus according to claim 9, wherein said document drawing/adjusting mechanism holds the delivered document for the predetermined period of time which includes at least a time period in which another document on said document-placing plate means is introduced into said document introduction passage by said document introduction means.

* * * * *